US009710995B2

(12) United States Patent
Chun

(10) Patent No.: US 9,710,995 B2
(45) Date of Patent: Jul. 18, 2017

(54) METHODS AND SYSTEMS FOR PLAYING SIC BO JACKPOT

(75) Inventor: Jay Chun, Hong Kong (CN)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/451,650

(22) Filed: Apr. 20, 2012

(65) Prior Publication Data

US 2012/0289300 A1 Nov. 15, 2012

Related U.S. Application Data

(63) Continuation of application No. 11/931,611, filed on Oct. 31, 2007, now Pat. No. 8,182,321, which is a (Continued)

(51) Int. Cl.

| | |
|---|---|
| ***G07F 17/32*** | (2006.01) |
| ***A63F 3/00*** | (2006.01) |
| ***A63F 1/00*** | (2006.01) |

(52) U.S. Cl.

CPC ..... *G07F 17/32* (2013.01); *A63F 3/00157* (2013.01); *G07F 17/322* (2013.01); (Continued)

(58) Field of Classification Search

CPC .... G07F 17/32; G07F 17/322; G07F 17/3258; G07F 17/3293; A63F 3/00157; (Continued)

(56) References Cited

U.S. PATENT DOCUMENTS

| | | | |
|---|---|---|---|
| 3,708,219 | A | 1/1973 | Forlini et al. |
| 3,810,627 | A | 5/1974 | Levy |

(Continued)

FOREIGN PATENT DOCUMENTS

| | | |
|---|---|---|
| CA | 2377577 | 6/2000 |
| EP | 0478412 | 4/1992 |

(Continued)

OTHER PUBLICATIONS

"Sic bo". Wikipedia, the free encyclopedia. First accessed Feb. 12, 2013. Current version Feb. 14, 2013. <http://en.wikipedia.org/wiki/Sic_bo>.*

(Continued)

*Primary Examiner* — William H McCulloch, Jr.
(74) *Attorney, Agent, or Firm* — Neal, Gerber & Eisenberg LLP

(57) ABSTRACT

A method with the steps of: playing a Sic Bo felt table game according to a set of conventional rules, allowing at least a first player to place a bet on the Sic Bo felt table game, allowing at least a second player to place a bet on the jackpot at a betting terminal where the second player can be the same as or different from the first player, determining the outcome of the Sic Bo felt table game according to a set of conventional casino game rules including a Sic Bo payout, and determining, by the betting terminal, the outcome of the jackpot according to a combination of dice thrown in the Sic Bo felt table game, and a separate jackpot wager bet that is only accepted at at least one live table game contributing to one jackpot pool having a jackpot pool payout.

12 Claims, 15 Drawing Sheets

Related U.S. Application Data continuation-in-part of application No. 11/042,732, filed on Jan. 24, 2005, now Pat. No. 7,918,723, and a continuation-in-part of application No. 11/198,218, filed on Aug. 5, 2005, and a continuation-in-part of application No. 11/874,158, filed on Oct. 17, 2007, now Pat. No. 8,210,920, and a continuation-in-part of application No. 11/800,885, filed on May 7, 2007, now Pat. No. 8,308,559.

(52) U.S. Cl.
CPC ..... *G07F 17/3258* (2013.01); *G07F 17/3293* (2013.01); *A63F 2001/001* (2013.01)

(58) Field of Classification Search
CPC ..... A63F 2001/001; A63F 2009/04; A63F 2009/0406
USPC ..... 463/10, 12, 22, 26, 28
See application file for complete search history.

(56) References Cited

U.S. PATENT DOCUMENTS 3,909,002 A 9/1975 Levy
3,998,309 A 12/1976 Mandas et al.
4,095,795 A 6/1978 Saxton
4,333,715 A 6/1982 Brooks
4,337,945 A 7/1982 Levy
4,339,798 A 7/1982 Hedges
4,448,419 A 5/1984 Telnaes
4,467,424 A 8/1984 Hedges
4,517,558 A 5/1985 Davids
4,607,844 A 8/1986 Fullerton
4,621,814 A 11/1986 Stepan et al.
4,659,082 A 4/1987 Greenberg
4,659,182 A 4/1987 Aizawa
4,662,635 A 5/1987 Enokian
4,718,672 A 1/1988 Okada
4,805,907 A 2/1989 Hagiwara
4,856,787 A 8/1989 Itkis
4,858,932 A 8/1989 Keane
4,861,041 A 8/1989 Jones
4,911,449 A 3/1990 Dickinson et al.
4,912,548 A 3/1990 Shanker et al.
4,926,327 A 5/1990 Sidley
4,998,737 A 3/1991 Lamle
5,033,744 A 7/1991 Bridgeman
5,042,818 A 8/1991 Weingardt
5,048,833 A 9/1991 Lamle
5,086,354 A 2/1992 Bass et al.
5,113,272 A 5/1992 Reamey
5,132,839 A 7/1992 Travis
5,248,142 A 9/1993 Breeding
5,265,882 A 11/1993 Malek
5,288,081 A 2/1994 Breeding
5,319,491 A 6/1994 Selbrede
5,325,830 A 7/1994 Hammer
5,342,047 A 8/1994 Heidel et al.
5,362,064 A 11/1994 Lofink
5,364,100 A 11/1994 Ludlow et al.
5,376,587 A 12/1994 Buchmann et al.
5,393,061 A 2/1995 Manship et al.
5,393,067 A 2/1995 Paulsen
5,395,119 A 3/1995 Jacob
5,395,120 A 3/1995 Malek
5,397,133 A 3/1995 Penzias
5,413,351 A * 5/1995 Franklin ..... 273/274
5,456,465 A 10/1995 Durham
5,467,893 A 11/1995 Landis et al.
5,472,194 A 12/1995 Breeding et al.
5,476,259 A 12/1995 Weingardt
5,490,670 A 2/1996 Hobert
5,494,296 A 2/1996 Grassa
5,539,547 A 7/1996 Ishii et al.
5,544,892 A 8/1996 Breeding
5,564,700 A * 10/1996 Celona ..... 463/27
5,580,055 A 12/1996 Hagiwara
5,580,310 A 12/1996 Orus et al.
5,585,821 A 12/1996 Ishikura et al.
5,586,937 A 12/1996 Menashe
5,588,650 A 12/1996 Eman et al.
5,589,980 A 12/1996 Bass et al.
5,605,334 A 2/1997 McCrea, Jr.
5,611,730 A 3/1997 Weiss
5,613,909 A 3/1997 Stelovsky
5,618,232 A 4/1997 Martin
5,639,092 A 6/1997 Macaisa
5,643,086 A 7/1997 Alcorn et al.
5,655,961 A 8/1997 Acres et al.
5,664,998 A 9/1997 Seelig
5,668,174 A 9/1997 Kawagishi
5,669,606 A 9/1997 Brown
5,673,917 A 10/1997 Vancura
5,707,287 A 1/1998 McCrea, Jr.
5,722,890 A 3/1998 Libby et al.
5,735,525 A 4/1998 McCrea, Jr.
5,743,523 A 4/1998 Kelly et al.
5,743,798 A 4/1998 Adams et al.
5,745,197 A 4/1998 Leung et al.
5,752,881 A 5/1998 Inoue
5,752,882 A 5/1998 Acres et al.
5,759,103 A 6/1998 Freels et al.
5,762,552 A 6/1998 Vuong
5,764,317 A 6/1998 Sadovnik et al.
5,766,076 A 6/1998 Pease et al.
5,770,533 A 6/1998 Franchi
5,772,509 A 6/1998 Weiss
RE35,864 E 7/1998 Weingardt
5,775,993 A 7/1998 Fentz
5,779,546 A 7/1998 Meissner
5,782,692 A 7/1998 Stelovsky
5,788,574 A 8/1998 Ornstein
5,791,992 A 8/1998 Crump et al.
5,795,225 A 8/1998 Jones
5,797,795 A 8/1998 Takemoto et al.
5,800,268 A 9/1998 Molnick
5,803,451 A 9/1998 Kelly et al.
5,806,854 A 9/1998 Coleman
5,820,459 A 10/1998 Acres et al.
5,820,461 A 10/1998 Pernatozzi
5,830,067 A 11/1998 Graves
5,836,817 A 11/1998 Acres et al.
5,836,818 A 11/1998 Jones
5,839,730 A 11/1998 Pike
5,839,731 A 11/1998 Feola
5,842,698 A 12/1998 Brown
5,851,149 A 12/1998 Xidos et al.
5,873,781 A 2/1999 Keane
5,876,283 A 3/1999 Parra
5,879,006 A * 3/1999 Bowling ..... 273/274
5,879,235 A 3/1999 Kaneko
5,885,085 A 3/1999 Fujita
5,888,136 A 3/1999 Herbert
5,909,876 A 6/1999 Brown
5,910,046 A 6/1999 Wada et al.
5,911,626 A 6/1999 McCrea, Jr.
5,921,865 A 7/1999 Scagnelli
5,931,471 A 8/1999 Bonito
5,951,397 A 9/1999 Dickinson
5,956,180 A 9/1999 Bass et al.
5,957,459 A 9/1999 Chae
5,961,119 A 10/1999 Brown
5,967,893 A 10/1999 Lawrence et al.
6,001,016 A 12/1999 Walker
6,015,346 A 1/2000 Bennett
6,019,374 A 2/2000 Breeding
6,027,115 A 2/2000 Griswold et al.
6,039,650 A 3/2000 Hill
6,050,895 A 4/2000 Luciano et al.
6,054,969 A 4/2000 Haisma
6,056,641 A 5/2000 Webb
6,059,658 A 5/2000 Mangano et al.
6,080,063 A 6/2000 Khosla

(56) References Cited

U.S. PATENT DOCUMENTS 6,083,105 A 7/2000 Ronin et al.
6,093,103 A 7/2000 McCrea, Jr.
6,113,493 A 9/2000 Walker et al.
6,117,012 A 9/2000 McCrea, Jr.
6,135,884 A 10/2000 Hedrick et al.
6,142,876 A 11/2000 Cumbers
6,146,270 A 11/2000 Huard
6,149,522 A 11/2000 Alcorn et al.
6,159,095 A 12/2000 Frohm
6,159,098 A 12/2000 Slomiany et al.
6,165,069 A 12/2000 Sines
6,213,875 B1 4/2001 Suzuki
6,217,447 B1 4/2001 Lofink
6,234,482 B1 * 5/2001 Henderson ..... 273/274
6,241,608 B1 6/2001 Torango
6,244,596 B1 6/2001 Kondratjuk
6,251,014 B1 6/2001 Stockdale et al.
6,252,707 B1 6/2001 Kleinberger et al.
6,254,481 B1 7/2001 Jaffe
6,254,484 B1 7/2001 McCrea, Jr.
6,264,561 B1 7/2001 Saffari
6,279,910 B1 8/2001 De
6,293,864 B1 9/2001 Romero
6,312,334 B1 11/2001 Yoseloff
6,315,666 B1 11/2001 Mastera et al.
6,336,857 B1 1/2002 McBride
6,337,513 B1 1/2002 Clevenger et al.
6,345,824 B1 2/2002 Selitzky
6,346,044 B1 2/2002 McCrea, Jr.
6,347,996 B1 2/2002 Gilmore et al.
6,361,437 B1 3/2002 Walker
6,368,216 B1 4/2002 Hedrick et al.
6,375,567 B1 4/2002 Acres
6,375,576 B1 4/2002 Margerie
6,379,244 B1 4/2002 Sagawa et al.
6,394,907 B1 5/2002 Rowe
6,398,220 B1 6/2002 Inoue
6,409,602 B1 6/2002 Wiltshire
6,416,827 B1 7/2002 Chakrapani et al.
6,435,970 B1 8/2002 Baerlocher et al.
6,444,496 B1 9/2002 Edwards et al.
6,445,185 B1 9/2002 Damadian et al.
6,460,848 B1 10/2002 Soltys
6,491,583 B1 12/2002 Gauselmann
6,503,147 B1 1/2003 Stockdale et al.
6,508,709 B1 1/2003 Karmarkar
6,511,072 B1 1/2003 Phommabouth et al.
6,511,375 B1 1/2003 Kaminkow
6,512,559 B1 1/2003 Hashimoto et al.
6,514,141 B1 2/2003 Kaminkow et al.
6,517,073 B1 2/2003 Vancura
6,517,433 B2 2/2003 Loose et al.
6,517,436 B2 2/2003 Soltys
6,517,437 B1 2/2003 Wells et al.
6,540,230 B1 4/2003 Walker
6,547,664 B2 4/2003 Saunders
6,569,018 B2 5/2003 Jaffe
6,575,541 B1 6/2003 Hedrick et al.
6,575,834 B1 6/2003 Lindo
6,582,301 B2 6/2003 Hill
6,582,302 B2 6/2003 Romero
6,585,591 B1 7/2003 Baerlocher et al.
6,588,758 B1 7/2003 Lee
6,607,195 B2 8/2003 Vancura
6,609,978 B1 8/2003 Paulsen
6,626,757 B2 9/2003 Oliveras
6,628,244 B1 9/2003 Hirosawa
D480,961 S 10/2003 Deadman
6,646,695 B1 11/2003 Gauselmann
6,652,378 B2 11/2003 Cannon et al.
6,656,048 B2 12/2003 Olsen
6,659,864 B2 12/2003 McGahn et al.
6,659,866 B2 12/2003 Choo et al.
6,661,425 B1 12/2003 Hiroaki
6,676,517 B2 1/2004 Beavers
6,685,567 B2 2/2004 Cockerille et al.
6,695,703 B1 2/2004 McGahn
6,702,675 B2 3/2004 Poole et al.
6,712,694 B1 3/2004 Nordman
6,712,696 B2 3/2004 Soltys
6,715,756 B2 4/2004 Inoue
6,717,728 B2 4/2004 Putilin
6,719,291 B1 4/2004 DeKeller
6,722,979 B2 4/2004 Gilmore et al.
6,726,564 B2 4/2004 Hogan
6,726,565 B2 4/2004 Hughs-Baird
6,755,741 B1 6/2004 Rafaeli
6,789,801 B2 9/2004 Snow
6,800,026 B2 10/2004 Cannon
6,802,777 B2 10/2004 Seelig et al.
6,804,763 B1 10/2004 Stockdale et al.
6,805,628 B2 10/2004 Romero
6,808,173 B2 10/2004 Snow
6,817,945 B2 11/2004 Seelig et al.
6,817,946 B2 11/2004 Motegi et al.
6,837,494 B2 1/2005 Lee
6,863,608 B1 3/2005 LeMay et al.
6,866,586 B2 3/2005 Oberberger et al.
6,887,157 B2 5/2005 LeMay et al.
6,890,259 B2 5/2005 Breckner et al.
6,896,614 B2 5/2005 Romero
6,899,625 B2 5/2005 Luciano
6,906,762 B1 6/2005 Witehira et al.
6,916,245 B1 7/2005 Vancura
6,937,298 B2 8/2005 Okada
7,008,319 B2 3/2006 Montgomery et al.
7,029,395 B1 4/2006 Baerlocher
7,070,505 B2 7/2006 Vancura
7,114,724 B2 10/2006 Ritzer
7,128,647 B2 10/2006 Muir
7,189,161 B1 3/2007 Wiltshire
7,198,272 B2 4/2007 Duhamel
7,204,753 B2 4/2007 Ozaki et al.
7,213,812 B2 5/2007 Schubert
7,220,181 B2 5/2007 Okada
7,226,040 B2 6/2007 Keister
7,252,288 B2 8/2007 Seelig et al.
7,255,643 B2 8/2007 Ozaki et al.
7,264,241 B2 9/2007 Schubert
7,303,473 B2 12/2007 Rowe
7,303,475 B2 12/2007 Britt
7,309,065 B2 12/2007 Yoseloff
7,309,284 B2 12/2007 Griswold et al.
7,311,604 B2 12/2007 Kaminkow
7,316,398 B1 1/2008 Pham
7,316,615 B2 1/2008 Soltys
7,322,884 B2 1/2008 Emori et al.
7,325,806 B1 2/2008 Feola
7,326,115 B2 2/2008 Baerlocher
7,329,179 B2 2/2008 Baerlocher
7,329,181 B2 2/2008 Hoshino et al.
7,351,146 B2 4/2008 Kaminkow
7,361,090 B2 * 4/2008 Lin ..... 463/22
7,367,884 B2 5/2008 Breeding
7,387,570 B2 6/2008 Randall
7,404,765 B2 7/2008 Soltys
7,407,438 B2 8/2008 Schubert
7,419,160 B1 9/2008 D'Ambrosio
7,434,805 B2 10/2008 Grauzer
7,451,987 B1 11/2008 Feola
7,452,270 B2 11/2008 Walker et al.
7,465,227 B2 12/2008 Baerlocher
7,470,185 B2 12/2008 Baerlocher
7,488,251 B2 2/2009 Kaminkow
7,503,849 B2 3/2009 Hornik et al.
7,537,456 B2 5/2009 Snow
7,566,274 B2 7/2009 Johnson et al.
7,572,183 B2 8/2009 Olivas
7,575,512 B2 8/2009 Kennedy
7,584,967 B2 9/2009 Webb
7,591,726 B2 9/2009 Baerlocher et al.
7,591,728 B2 9/2009 Gioia
7,614,948 B2 * 11/2009 Saffari ..... 463/19
7,618,319 B2 11/2009 Casey et al.

(56) References Cited

U.S. PATENT DOCUMENTS 7,621,533 B2 11/2009 Kenny
7,666,086 B2 2/2010 Baerlocher
7,666,087 B2 2/2010 Hughs-Baird
7,699,698 B2 4/2010 Randall
7,731,586 B2 6/2010 Letovsky
7,735,657 B2 6/2010 Johnson
7,753,798 B2 7/2010 Soltys
7,758,419 B2 7/2010 Rowe et al.
7,762,889 B2 7/2010 Shigeta
7,769,232 B2 8/2010 Downs
7,775,524 B2 8/2010 Lutnick et al.
7,775,868 B2 8/2010 Toyoda
7,780,515 B2 8/2010 Okada
7,789,743 B2 9/2010 Walker et al.
7,819,744 B2 10/2010 Hughs-Baird
7,822,641 B2 10/2010 Abbott et al.
7,828,643 B2 11/2010 Baerlocher
7,837,547 B2 11/2010 Cannon
7,846,018 B2 12/2010 Baerlocher
7,867,077 B2 1/2011 Baerlocher et al.
7,878,892 B2 2/2011 Sines et al.
7,905,771 B2 3/2011 Walker et al.
7,905,774 B2 3/2011 Walker et al.
7,909,688 B2 3/2011 Yoshizawa
7,914,368 B2 3/2011 Chun
7,914,372 B2 3/2011 Tessmer et al.
7,918,723 B2 4/2011 Chun
7,922,587 B2 4/2011 Chun
7,931,531 B2 4/2011 Oberberger
7,950,993 B2 5/2011 Oberberger
7,963,845 B2 6/2011 Baerlocher
7,967,674 B2 6/2011 Baerlocher
7,976,378 B2 7/2011 Baerlocher
7,980,948 B2 7/2011 Rowe et al.
8,002,281 B2 8/2011 Kearns
8,020,866 B2 9/2011 Walker et al.
8,066,564 B2 11/2011 Randall
8,087,984 B2 1/2012 Okujyo
8,087,985 B2 1/2012 Katz
8,087,999 B2 1/2012 Oberberger et al.
8,109,821 B2 2/2012 Kovacs
8,123,618 B2 2/2012 Karmarkar
8,128,491 B2 3/2012 Vasquez et al.
8,128,492 B2 3/2012 Vasquez et al.
8,152,617 B2 4/2012 Katz
8,152,624 B2 4/2012 Gerrard et al.
8,152,629 B2 4/2012 DeWaal et al.
8,167,711 B2 5/2012 Baerlocher
8,172,660 B2 5/2012 Lancaster et al.
8,177,627 B2 5/2012 Baerlocher
8,182,321 B2 * 5/2012 Chun ..... 463/12
8,182,323 B2 5/2012 Okada
8,197,335 B2 6/2012 DeWaal et al.
8,202,153 B2 6/2012 Baerlocher
8,206,212 B2 6/2012 Iddings et al.
8,210,920 B2 7/2012 Chun
8,231,456 B2 7/2012 Zielinski
8,235,801 B2 8/2012 Tan
8,267,765 B2 9/2012 Baerlocher
8,305,550 B2 11/2012 Jung et al.
8,308,559 B2 * 11/2012 Chun ..... 463/31
8,313,373 B2 11/2012 Walker et al.
8,317,589 B2 11/2012 Tessmer et al.
8,323,105 B2 12/2012 Chun
8,342,954 B2 1/2013 Oberberger et al.
8,360,852 B2 1/2013 Randall
8,360,859 B2 1/2013 Walker et al.
8,403,740 B2 3/2013 Kovacs et al.
8,425,305 B2 4/2013 Baerlocher et al.
8,430,735 B2 4/2013 Oberberger
8,430,739 B2 4/2013 Rodgers
8,454,427 B2 6/2013 Baerlocher
8,460,095 B2 6/2013 Tan
8,474,820 B2 7/2013 Walker et al.
8,485,888 B2 7/2013 Baerlocher
8,496,521 B2 7/2013 Randall
8,500,533 B2 8/2013 Lutnick et al.
8,506,380 B2 8/2013 Hughes et al.
8,517,824 B2 8/2013 Zielinski et al.
8,613,650 B2 12/2013 Kovacs et al.
9,135,775 B2 9/2015 Pececnik
9,214,056 B2 12/2015 Kovacs et al.
2001/0000118 A1 4/2001 Sines
2001/0013681 A1 8/2001 Bruzzese et al.
2001/0029200 A1 10/2001 Romero
2002/0002070 A1 1/2002 Romero
2002/0002073 A1 1/2002 Montgomery
2002/0015489 A1 2/2002 Ben-David
2002/0036380 A1 * 3/2002 Perrie et al. ..... 273/146
2002/0045472 A1 4/2002 Adams
2002/0068635 A1 6/2002 Hill
2002/0072407 A1 6/2002 Soltys
2002/0077170 A1 6/2002 Johnson
2002/0077712 A1 6/2002 Safaei et al.
2002/0090988 A1 * 7/2002 Frost et al. ..... 463/17
2002/0094869 A1 7/2002 Harkham
2002/0111205 A1 8/2002 Beavers
2002/0115489 A1 8/2002 Jordan
2002/0147042 A1 10/2002 Vuong
2002/0147047 A1 10/2002 Letovsky
2002/0173354 A1 11/2002 Winans et al.
2003/0003997 A1 1/2003 Vuong
2003/0013510 A1 1/2003 Vuong
2003/0027624 A1 2/2003 Gilmore et al.
2003/0032478 A1 2/2003 Takahama et al.
2003/0032479 A1 2/2003 LeMay et al.
2003/0050107 A1 3/2003 Moody
2003/0060271 A1 3/2003 Gilmore et al.
2003/0064781 A1 4/2003 Muir
2003/0067112 A1 4/2003 Grauzer
2003/0069071 A1 4/2003 Britt
2003/0073497 A1 4/2003 Nelson
2003/0087690 A1 5/2003 Loose et al.
2003/0104854 A1 6/2003 Cannon
2003/0109306 A1 6/2003 Karmarkar
2003/0130028 A1 7/2003 Aida et al.
2003/0151199 A1 8/2003 Lee
2003/0151201 A1 8/2003 Lee
2003/0176214 A1 9/2003 Burak et al.
2003/0181231 A1 * 9/2003 Vancura ..... 463/9
2003/0203756 A1 10/2003 Jackson
2003/0224854 A1 12/2003 Joao
2003/0232651 A1 12/2003 Huard
2003/0234489 A1 12/2003 Okada
2003/0236113 A1 12/2003 Webb
2003/0236114 A1 12/2003 Griswold et al.
2003/0236118 A1 12/2003 Okada
2004/0002379 A1 1/2004 Parrott et al.
2004/0023712 A1 2/2004 Oliver
2004/0023714 A1 2/2004 Asdale
2004/0023722 A1 2/2004 Vuong
2004/0029636 A1 2/2004 Wells
2004/0063490 A1 4/2004 Okada
2004/0066475 A1 4/2004 Searle
2004/0070146 A1 4/2004 Snow
2004/0077425 A1 * 4/2004 Goossens et al. ..... 472/137
2004/0082372 A1 4/2004 Romero
2004/0084843 A1 5/2004 Snow
2004/0087357 A1 5/2004 Johnson
2004/0090003 A1 5/2004 Snow
2004/0090005 A1 5/2004 Snow
2004/0108656 A1 6/2004 Snow
2004/0116177 A1 * 6/2004 Frost et al. ..... 463/17
2004/0116178 A1 6/2004 Okada
2004/0116179 A1 6/2004 Nicely
2004/0145116 A1 7/2004 Calvo et al.
2004/0147303 A1 7/2004 Imura et al.
2004/0147314 A1 7/2004 LeMay et al.
2004/0150162 A1 8/2004 Okada
2004/0162146 A1 8/2004 Ooto
2004/0166925 A1 8/2004 Emori et al.
2004/0166941 A1 8/2004 Fujimoto
2004/0171423 A1 9/2004 Silva et al.
2004/0183972 A1 9/2004 Bell

(56) References Cited

U.S. PATENT DOCUMENTS

2004/0185933 A1 9/2004 Nicely
2004/0192430 A1 9/2004 Burak et al.
2004/0198485 A1 10/2004 Loose et al.
2004/0207154 A1 10/2004 Okada
2004/0209666 A1 10/2004 Tashiro
2004/0209667 A1 10/2004 Emori et al.
2004/0209668 A1 10/2004 Okada
2004/0209671 A1 10/2004 Okada
2004/0209678 A1 10/2004 Okada
2004/0209683 A1 10/2004 Okada
2004/0214635 A1 10/2004 Okada
2004/0214637 A1 10/2004 Nonaka
2004/0224747 A1 11/2004 Okada
2004/0224777 A1 11/2004 Smith
2004/0233663 A1 11/2004 Emslie et al.
2004/0235542 A1 11/2004 Stronach
2004/0239582 A1 12/2004 Seymour
2005/0003886 A1 1/2005 Englman et al.
2005/0032571 A1 2/2005 Asonuma
2005/0037843 A1 2/2005 Wells et al.
2005/0049032 A1 3/2005 Kobayashi
2005/0049046 A1 3/2005 Kobayashi
2005/0062227 A1 3/2005 Grauzer
2005/0062410 A1 3/2005 Bell et al.
2005/0063055 A1 3/2005 Engel
2005/0073102 A1 4/2005 Yoseloff
2005/0079913 A1 4/2005 Inamura
2005/0085292 A1 4/2005 Inamura
2005/0153772 A1 7/2005 Griswold et al.
2005/0153775 A1 7/2005 Griswold et al.
2005/0176493 A1 8/2005 Nozaki et al.
2005/0176507 A1 8/2005 Ephrati et al.
2005/0192090 A1 9/2005 Muir et al.
2005/0192099 A1 9/2005 Nguyen et al.
2005/0206582 A1 9/2005 Bell et al.
2005/0208994 A1 9/2005 Berman
2005/0218597 A1 10/2005 Parsadaian
2005/0233794 A1 10/2005 Cannon
2005/0233799 A1 10/2005 LeMay et al.
2005/0233803 A1 10/2005 Yang
2005/0239539 A1 10/2005 Inamura
2005/0266912 A1 12/2005 Sekiguchi
2005/0282618 A1 12/2005 OHalloran
2005/0282625 A1 12/2005 Nicely
2005/0285337 A1 12/2005 Durham et al.
2006/0009283 A1 1/2006 Englman
2006/0030399 A1 2/2006 Baerlocher
2006/0033267 A1* 2/2006 Wong ..... 273/142 R
2006/0040733 A1 2/2006 Baerlocher
2006/0052149 A1 3/2006 Bursill
2006/0052168 A1 3/2006 Shacham
2006/0063577 A1 3/2006 Downs
2006/0071429 A1 4/2006 Okujyo
2006/0073882 A1 4/2006 Rozkin et al.
2006/0092170 A1 5/2006 Bathiche et al.
2006/0100014 A1 5/2006 Griswold et al.
2006/0103071 A1 5/2006 Ritzer
2006/0103951 A1 5/2006 Bell et al.
2006/0125745 A1 6/2006 Evanicky
2006/0128472 A1 6/2006 Beavers
2006/0135240 A1 6/2006 Barshack
2006/0135243 A1 6/2006 Englman
2006/0148547 A1 7/2006 Montgomery
2006/0166726 A1 7/2006 Chun
2006/0166727 A1 7/2006 Burak
2006/0166731 A1 7/2006 Yoshimi
2006/0178181 A1 8/2006 Chun
2006/0189382 A1 8/2006 Muir et al.
2006/0191177 A1 8/2006 Engel
2006/0226605 A1 10/2006 Kenny
2006/0258446 A1 11/2006 Nguyen et al.
2006/0284574 A1 12/2006 Emslie et al.
2006/0287042 A1 12/2006 Osawa
2006/0287058 A1 12/2006 Resnick
2006/0290594 A1 12/2006 Engel et al.
2007/0004510 A1 1/2007 Underdahl et al.
2007/0010315 A1 1/2007 Hein
2007/0013127 A1* 1/2007 Ellis ..... 273/146
2007/0018406 A1* 1/2007 Kennedy ..... 273/307
2007/0021198 A1 1/2007 Muir et al.
2007/0026922 A1 2/2007 Lindo
2007/0026947 A1 2/2007 Chun
2007/0032283 A1 2/2007 Chun
2007/0060259 A1 3/2007 Pececnik
2007/0129123 A1 6/2007 Eryou et al.
2007/0135204 A1 6/2007 Nicely
2007/0155512 A1 7/2007 Wells
2007/0218968 A1 9/2007 Snow
2007/0243927 A1 10/2007 Soltys
2007/0243929 A1 10/2007 Skotarczak
2007/0243935 A1 10/2007 Huizinga
2008/0001358 A1* 1/2008 Scott et al. ..... 273/274
2008/0009334 A1 1/2008 Walker
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0026807 A1 1/2008 Moshal
2008/0045288 A1 2/2008 Moshal
2008/0064467 A1 3/2008 Reiner
2008/0076499 A1 3/2008 Lowery
2008/0085769 A1 4/2008 Lutnick
2008/0108400 A1 5/2008 Chun
2008/0113778 A1 5/2008 Chun
2008/0113783 A1 5/2008 Czyzewski
2008/0146311 A1 6/2008 Walker
2008/0146344 A1 6/2008 Rowe et al.
2008/0149705 A1 6/2008 Giobbi et al.
2008/0182650 A1 7/2008 Randall et al.
2008/0194334 A1 8/2008 Kuok
2008/0214274 A1 9/2008 Thomas
2008/0230993 A1 9/2008 Chun
2008/0231611 A1 9/2008 Bathiche et al.
2008/0248865 A1 10/2008 Tedesco et al.
2008/0254881 A1 10/2008 Lutnick
2008/0274802 A1 11/2008 Joao
2008/0280667 A1* 11/2008 Chun ..... 463/20
2008/0280668 A1 11/2008 Chun
2008/0305855 A1 12/2008 Czyzewski
2008/0318668 A1 12/2008 Ching et al.
2009/0029755 A1 1/2009 Chun
2009/0029766 A1 1/2009 Lutnick et al.
2009/0061974 A1 3/2009 Lutnick
2009/0069079 A1 3/2009 Britt
2009/0075724 A1 3/2009 Breeding
2009/0111573 A1 4/2009 Iddings
2009/0115133 A1 5/2009 Kelly
2009/0124323 A1 5/2009 Dunn
2009/0124385 A1 5/2009 Cuddy
2009/0137313 A1 5/2009 Young
2009/0176547 A1 7/2009 Katz
2009/0203433 A1 8/2009 Olivas
2009/0221360 A1 9/2009 Wooding
2009/0252546 A1* 10/2009 Kaleta et al. ..... 401/139
2010/0056262 A1 3/2010 Englman
2010/0102511 A1 4/2010 Tammesoo
2010/0105457 A1 4/2010 Miller
2010/0105459 A1 4/2010 Miller
2010/0111820 A1 5/2010 Natura et al.
2010/0113119 A1 5/2010 Miller
2010/0117299 A1 5/2010 Nicely
2010/0120506 A1 5/2010 Davis et al.
2010/0130280 A1 5/2010 Arezina et al.
2010/0222133 A1 9/2010 Spencer
2010/0234086 A1 9/2010 Michaelson
2010/0255897 A1 10/2010 Pececnik
2010/0295247 A1 11/2010 LaDuca
2011/0031694 A1 2/2011 Cohen
2011/0039612 A1 2/2011 Pececnik
2011/0059800 A1 3/2011 Anderson
2011/0105207 A1 5/2011 Chun
2011/0111824 A1 5/2011 Cuddy et al.
2011/0120506 A1 5/2011 Sakai
2011/0140362 A1 6/2011 Chun

(56) References Cited

U.S. PATENT DOCUMENTS

| | | | | |
|---|---|---|---|---|
| 2011/0159965 | A1 | 6/2011 | Chun | |
| 2012/0064958 | A1 | 3/2012 | Lisandro | |
| 2012/0270625 | A1 | 10/2012 | Chun | |
| 2012/0276973 | A1* | 11/2012 | Kishi | 463/16 |
| 2012/0289300 | A1* | 11/2012 | Chun | 463/13 |
| 2013/0165201 | A1* | 6/2013 | Chun | 463/20 |
| 2013/0184044 | A1* | 7/2013 | Frost et al. | 463/17 |
| 2013/0190075 | A1 | 7/2013 | Chun | |
| 2013/0288764 | A1* | 10/2013 | Chun | 463/12 |
| 2013/0288779 | A1* | 10/2013 | Chun | 463/25 |
| 2014/0135088 | A1 | 5/2014 | Chun | |
| 2016/0335851 | A1* | 11/2016 | Litman | G07F 17/3293 |
| 2017/0018146 | A9* | 1/2017 | Chun | G01J 3/0286 |

FOREIGN PATENT DOCUMENTS

| | | | |
|---|---|---|---|
| EP | 1101513 | A2 | 5/2001 |
| EP | 1467329 | | 10/2004 |
| EP | 1892683 | | 2/2008 |
| GB | 2408696 | | 6/2005 |
| GB | 2403429 | | 7/2006 |
| GB | 2430385 | | 3/2007 |
| JP | H0956889 | A | 3/1997 |
| JP | 2006181270 | A | 7/2006 |
| WO | WO 99/19027 | | 4/1999 |
| WO | WO 99/42889 | | 8/1999 |
| WO | WO 99/44095 | | 9/1999 |
| WO | 0079467 | | 12/2000 |
| WO | WO 01/09664 | | 2/2001 |
| WO | WO 01/15127 | | 3/2001 |
| WO | WO 01/15128 | | 3/2001 |
| WO | WO 01/15132 | | 3/2001 |
| WO | 0217841 | | 3/2002 |
| WO | WO 04/001486 | | 12/2003 |
| WO | WO 2004/102520 | | 11/2004 |
| WO | 2005056134 | | 6/2005 |
| WO | WO 2005065793 | A1 * | 7/2005 |
| WO | WO 2006/034192 | | 3/2006 |
| WO | WO 2006/038819 | | 4/2006 |
| WO | 2007016035 | | 2/2007 |
| WO | WO 2007/032945 | | 3/2007 |
| WO | WO 2007/073534 | | 6/2007 |
| WO | 2007099334 | | 3/2008 |
| WO | 2008026950 | | 3/2008 |
| WO | 2008092385 | | 8/2008 |
| WO | 2009107131 | | 9/2009 |

OTHER PUBLICATIONS

International Search Report for PCT/CA2006/002069, mailed Mar. 20, 2007, 16 pgs.

International Search Report for PCT/CA2006/001295, mailed Nov. 2, 2006, 17 pgs.

EZ Baccarat. DP Stud, Inc., www.ezbaccarat.com, 2 pgs. (2003).

"Scarne's Encyclopedia of Card Games," by John Scarne, 1973, HarperCollins, New York, N.Y., chapter on banking games.

"Scarne's Complete Guide to Gambling," by John Scarne, 1961, Simon & Schuster, New York, N.Y., chapter on roulette.

Macau Patent Application Notice of Allowance, Macau Patent Application I/150.

Parlett, David. "A History of Poker." Copyright 2005. Accessed Aug. 23, 2013. 13pp. <http://www.pagat.com/poker/history.html>.

* cited by examiner

FIG. 4A
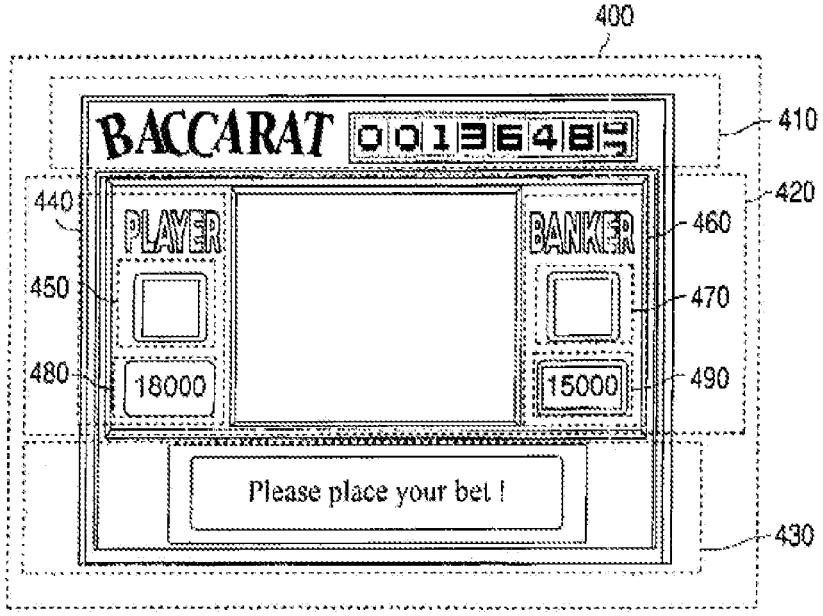
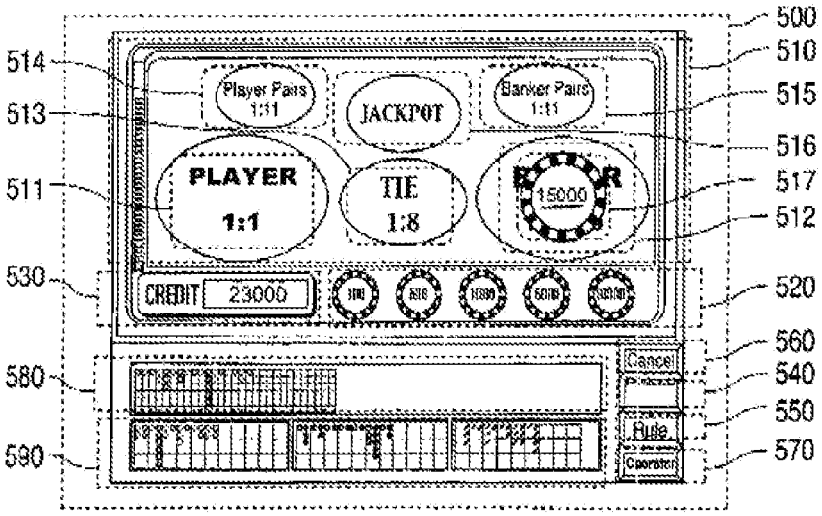
FIG. 4B

METHODS AND SYSTEMS FOR PLAYING SIC BO JACKPOT

CROSS REFERENCE TO RELATED APPLICATIONS

This application is a continuation of application Ser. No. 11/931,611 filed on Oct. 31, 2007, now U.S. Pat. No. 8,182,321 which is a continuation-in-part application of U.S. application Ser. No. 11/042,732, filed on Jan. 24, 2005 (now issued U.S. Pat. No. 7,918,723), a continuation-in-part application of U.S. application Ser. No. 11/198,218, filed on Aug. 5, 2005, a continuation-in-part application of U.S. application Ser. No. 11/874,158, filed on Oct. 17, 2007 now U.S. Pat. No. 8,210,920 and a continuation-in-part application of U.S. application Ser. No. 11/800,885, filed on May 7, 2007 now U.S. Pat. No. 8,308,559. The teachings all of these applications are incorporated herein in their entirety by reference.

BACKGROUND OF THE INVENTION

The present invention is generally directed to a method of play and apparatus for playing a casino game that allows a player to bet on jackpot.

Baccarat is one of the more popular gambling games played in casinos or gaming establishments. As is well known, the game is played on an elongated table having a game board displayed along the upper surface of the table. The game board displays certain wagering areas, and the elongated table allows for the seating of multiple players or bettors (1-16) and the positioning of the multiple dealers (3) necessary for operating the casino game. Bettor locations are typically numbered on the table and each bettor location has an area designated for a wager on the bank hand and an area designated for a wager on the player hand. Baccarat uses a standard deck of 52 playing cards and is usually dealt from a shoe having multiple decks that have been shuffled together prior to the beginning of play.

A feature of conventional baccarat games is that they have relatively simple rules. However, the simplicity of the rules has led to a corresponding simplicity in the relatively few types of wagers which may be placed during the play of the game, which may limit interest on the part of the player(s) and thus further limit the casino in terms of profit and payout. The embodiments described below address the above-described issues and needs.

SUMMARY OF THE INVENTION

Provided herein are methods and systems therefore for playing a modified live baccarat game. The methods allow the wagering on the live baccarat games or felt table games according to conventional rules. In addition, the methods provided herein allow betting on a side bet or wager for jackpot. In some embodiments, outcomes of the jackpot betting can be determined by combinations of cards that involve at least one zero-point card, described below. In some other embodiments, outcomes of the jackpot betting can be determined by specific combinations of cards defined below. The present invention also provides a jackpot gaming method that allows the banker to make initial contributions for the jackpot game.

The method for playing live baccarat described herein includes the following steps:

dealing cards to a player hand and a bank hand according to a set of conventional baccarat rules, allowing at least a first player to place a bet on live baccarat felt table game, allowing at least a second player to place a bet on jackpot where the second player can be the same as or different from the first player, determining the outcome of the live baccarat game or felt table game according to the set of conventional baccarat rules, and determining the outcome of the jackpot according to a combination of cards defined herein.

The present invention also discloses a software program or a set of software programs for carrying out any or all steps of the betting method described herein. The live baccarat game can also be incorporated into an electronic device or an entertainment gaming machine.

BRIEF DESCRIPTION OF DRAWINGS

FIGS. 4A and 4B show the detailed layout of the betting terminal of a baccarat machine.

DETAILED DESCRIPTION

Figure 1:
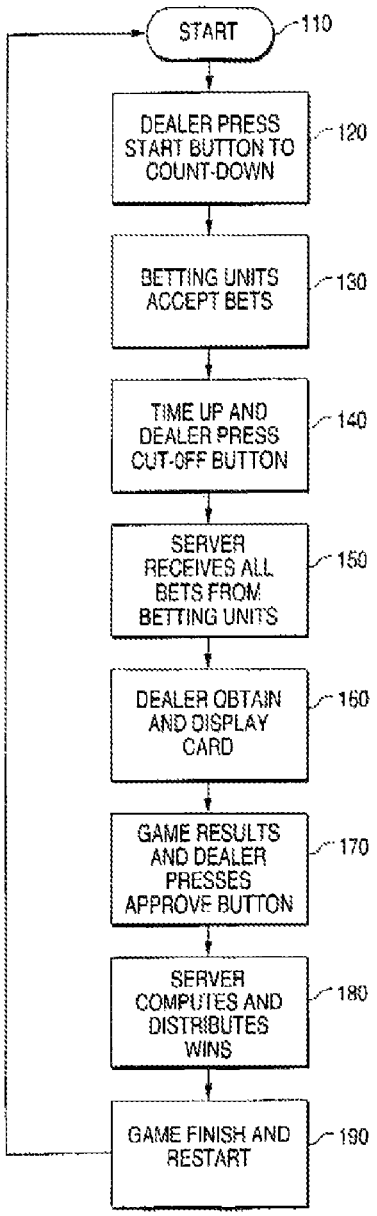
FIG. 1 is a flow chart disclosing the incorporation of the present betting methods in the game of baccarat.

Provided herein are methods and systems therefore for playing a modified live baccarat game. The methods allow the wagering on the live baccarat games or felt table games according to conventional rules. In addition, the methods provided herein allow betting on a side bet or wager for jackpot. The present invention also provides a jackpot gaming method that allows the banker to make initial contributions for the jackpot game. As used herein, a zero-point card refers to any of the 10, J, Q, or K, and the banker refers to one who owns or operates the live baccarat establishment.

In general, the method for playing the jackpot described herein includes the following steps:

dealing cards to a player hand and a bank hand according to a set of conventional baccarat rules, allowing at least a first player to place a bet on live baccarat or felt table game, allowing at least a second player to place a bet on jackpot where the second player can be the same as or different from the first player, determining the outcome of the live baccarat game according to the set of conventional baccarat or felt table game rules, and determining the outcome of the jackpot according to a combination of cards defined below.

In some embodiments, the outcome of the jackpot can be a winning jackpot by from 1% to 100% of the jackpot, e.g., about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or about 100% of the jackpot. As used herein, the term "about" shall encompass any percentage that falls within +5% of the indicated value. Live baccarat games and felt table games are well known in the art. Examples of felt table games include, e.g., a Roulette game, a Black Jack & Craps game, a Sic Bo game, or a Fish-Prawn-Crab game. The rules of playing these games are well established. Rules of a few examples of these games are described below for illustration only and shall not be construed to limit the scope of the present invention.

The present invention also provides a software program or a set of software programs for carrying out any or all steps of the betting method described herein. The baccarat game can also be incorporated into an electronic device or an entertainment gaming machine. Representative electronic devices include, but are not limited to, laptop computers or desktop computers.

Live Baccarat Game

The object of baccarat is for the bettor to successfully wager on whether the bank's hand or the player's hand is going to win. The bettor receives even money for his wager if he selects the winning hand and loses his wager if he selects the losing hand. Because of the rules of play of baccarat, the bank's hand has a slightly higher chance of winning than does the player's hand. Therefore, if the bettor wagers on the bank's hand, the bettor is required to pay to the gaming establishment a commission (typically 5%) of the amount the bettor wins. No commission is paid if the bettor successfully wagers on the player's hand.

The term "wager", as used herein, can be used interchangeably with the term "bet." The term "wagering" is used interchangeably with the term "betting."

Conventional methods of playing baccarat are described as follows:

A multiple number of decks of standard playing cards, 52 in number, are used; typically six to twelve decks are shuffled together and placed in a shoe from which the cards are dealt during the play of the game.

Each bettor makes a wager on whether the bank's hand or the player's hand will win. After all wagers are made, two cards are dealt from the shoe to the bank position and two cards are dealt from the shoe to the player's position on the table layout. The cards are turned face up and the value of the bank hand and the player hand is determined.

Aces count as one; kings, queens, jacks and tens count as zero and the other cards count as their respective face value. The suits (hearts, diamonds, spades and clubs) have no meaning in baccarat. The highest hand value in baccarat is nine. All hand values range from a low of zero to a high of nine. If when the cards are added together, the total of the hand exceeds nine, then the hand value is determined by subtracting ten from the total of the hand. For example, a seven and nine total sixteen, but the hand value is six. An Ace and a nine total ten, but the hand value is zero.

A two card total of eight or nine is called a "natural"; a two card total of zero is called a "baccarat". As will be explained hereafter, in certain situations in the play of the game, a third card will be dealt. The value of this third card is added to the total of the first two cards and a new hand value is established. Again, if the new hand total exceeds nine, the hand value is determined by subtracting ten from the total of the hand. Wagering locations are provided on the baccarat table layout. Whichever of the bank hand or the player hand is closest to a total of nine is the winner.

The way of betting may differ in different gaming establishments. In the U.S., for example, prior to the deal, each bettor can make one of three wagers: 1) that the bank hand will win, 2) that the player hand will win, or 3) that the bank hand and the player hand will tie. In Macau, for example, one can make one of five wagers: 1) that the bank hand will win, 2) that the player hand will win, 3) that the bank hand and the player hand will tie, 4) that the first two cards in the bank hand are of the same kind, regardless of the type of suit, forming a Bank Pair, or (5) that the first two cards in the player hand are of the same kind, regardless of the type of suit, forming a Player Pair.

All winning bank hand wagers in scenario 1) in both the U.S. and Macau are paid off at odds of one-to-one and the house charges a five percent (5%) commission on the amount won by the bettor. For example, if a bettor wagers $100 on the bank hand and the bank hand wins, the bettor wins $100 and is charged a $5 commission on the amount that the bettor won. The bettor is not charged any commission on the amount of his wager.

All wagers that select winning player hand in scenario 2) in both the U.S. and Macau are paid off at odds of one-to-one and the bettor is not charged any commission on the amount of his winnings or his wager.

All winning wagers on the tie in scenario 3) in both the U.S. and Macau can be paid off at odds of eight-to-one (depending on the gaming establishment) and the bettor is not charged any commission on the amount of his winnings or his wager. If a tie hand occurs, all wagers on the bank hand and all wagers on the player hand are "pushes" and the amount wagered is returned to the bettor.

All winning wagers on the Bank Pair bet in scenario 4) in Macau can be paid off at odds of eleven-to-one (depending on the gaming establishment) and the bettor is not charged any commission on the amount of his winnings or his wager.

All winning wagers on the Player Pair bet in scenario 5) in Macau can be paid off at odds of eight-to-one (depending on the gaming establishment) and the bettor is not charged any commission on the amount of his winnings or his wager.

The play of baccarat typically uses three casino dealers to operate the game. The casino dealers jointly participate in the shuffling of the decks of cards. After the shuffle is completed, one of the players is typically asked to cut the decks using a plastic cut card. The dealer then separates and restacks the cards from the point of the cut and the dealer or a player then inserts the plastic cut card no less than fifteen cards (in Las Vegas, U.S.) or no less than twelve cards (in Macau) from the ends of the stacked decks and the entire stacked decks are placed into a shoe from which the cards are dealt during the play of the game. When the inserted plastic cut card appears during play, the hand in progress is completed and that round of play then ends. The cards are reshuffled to prepare for the next round of baccarat.

In conventional baccarat, the bettors deal the cards used in the game. Initially, one of the casino dealers (called the "caller") passes the shoe to the bettor sitting in seat number "1" at the baccarat table. After all wagers have been made, the caller tells the bettor with the shoe to begin the deal. The bettor deals a first card to the caller, a first card to himself, a second card to the caller and a second card to himself. All cards are dealt face down. The two cards given to the caller represent the player hand and the two cards kept by the bettor who is dealing the cards represent the bank hand.

The caller than allows one of the other bettors to turn up the player's hand. Traditionally, this honor is given to the bettor who has made the largest wager. The bettor turns up the two cards of the player's hand and tosses them to the caller. The caller places these two cards face up in the table location designated for the "player hand" and the caller announces the point total of the player hand.

The bettor who has the shoe then turns over the cards of the bank hand and tosses these two cards to the caller. The caller places these two cards face up in the table location designated for the "bank hand" and the caller announces to point total of the bank hand. Depending on the point total of the player's hand and the bank's hand, one more card may be dealt to either the player's hand, the bank's hand, or both. The rules for determining whether a third card is dealt are fixed rules, there is no discretion for either the player's hand or the bank's hand on whether a third card is dealt.

If either the player hand or the bank hand has a point total of eight or nine on the first two cards, no third card is dealt to either hand and the hand with the highest point total is the winner (or the hand is a tie, as the case may be). If neither the player hand or the bank hand has a point total of eight or nine, then there is a possibility of a third card draw.

The third card draw rules are as follows:

Rule #1: If the initial two card player hand has a point total of 0, 1, 2, 3, 4 or 5, draws a third card. If the initial two card player hand has a point total of 6 or 7, the player hand stands and does not receive a third card.

Rule #2: If the player hand stands and does not draw a third card, then the bank hand follows Rule #1. In other words, if the player hand has a point total of 6 or 7, the bank hand draws a third card on a point total of 0, 1, 2, 3, 4 or 5 and the bank hand stands on a point total of 6 or 7.

Rule #3: If the player hand draws a third card, the bank hand must draw or stand as described in Table 1.

TABLE 1

| Bank hand two card point total | Bank hand draws when the player's hand third card is: | Bank hand stands when the player's hand third card is: |
|---|---|---|
| 0, 1 or 2 | Bank always draws | |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | | Bank always stands |

All third card draw determinations are automatically made by the caller who is skilled in the game of baccarat. When the rules of baccarat require a third card for the player hand, the caller will request a card for the player hand. After the player hand is completed, the bank hand is completed in the same fashion. The caller then declares which hand has the highest point total and declares that hand the winner (or the caller declares a tie hand as the case may be).

In conventional baccarat the bettor who acts as the dealer continues to deal the cards until the player hand wins. As soon as the player hand wins, it is customary to pass the shoe counterclockwise around the baccarat table to the next bettor so that each bettor has the opportunity to deal the cards. Any bettor may decline to deal the cards. The fact that one of the bettors is physically dealing the cards has no affect on the outcome of the game because the rules for drawing and standing do not allow any discretion on the part of the players.

In some embodiments, the players can play the game according to conventional baccarat rules, which may vary from place to place. In one embodiment, the baccarat game is played according to the U.S. rules as used in Las Vegas. In another embodiment, the baccarat game is played according to the baccarat rules promulgated by the government of Macau Special Administration Region.

In some embodiments, there is a maximum limit on the total bet can be made through a single betting terminal for the live baccarat game. In one embodiment, the maximum bet can be made through one terminal for live baccarat is, for example, HK$20,000.

Roulette

Roulette games are generally grouped into two categories: the European Roulette or English Roulette or the American Roulette. The following provides a general description of the game of Roulette and the rules playing the game.

American Roulette

The Wheel

The game of American Roulette is played on a wheel which consists of thirty-eight slots, each with its own number. The numbers on a Roulette wheel are 1-36, 0, and 00. The numbers alternate pairs of odd numbers with pairs of even numbers. The numbers also alternate between black and red. Both the 0 and 00 slots are green. A dealer, or croupier spins the wheel in one direction and then rolls a small ball in the other direction. The ball then drops into one of the slots as it begins to slow down.

The Table

The table is designed so that the numbers, not including 0 and 00, are lined up into three columns, each of twelve numbers, the first row is 1,2,3; the second row is 4,5,6 and so on. The rest of the table is devoted to the myriad bets the game entails. Betting is broken down into two major categories, inside bets and outside bets. There is no limit to the number of bets one can play Inside Bets Straight Bets This is betting that one particular number on the wheel will come up. This bet is done by placing a chip on top of the number on which you want to bet. If that number wins, the payoff is 35 to 1.

Split Bets

This is betting that one of two numbers that lie next to each other on the table will win. Placing a chip on the line that separates two numbers does this. You win if the ball lands on either number. The payoff is 17 to 1.

Street Bet, Trio Bet, or Three Number Bet

In this bet, a player is wagering that any number in a particular row will hit on the next spin. To make this bet, you must place a chip in the outside line of the row on which you want to bet. You win if any number in the row comes up. The payoff is 11 to 1.

Corner Bet, Square Bet, or Four-Number Bet

This bets that one of four numbers will hit on the next spin. The numbers should all be touching and moving a chip into the center of four numbers places the bet. If one of these numbers comes up, you win. This bets pays 8 to 1.

Five-Number Bet

This is betting that either the 0, 00, 1, 2, or 3 will come up on the next roll. To take this bet, place a chip on the outside line that divides the 0 and 1. You will be paid 6 to 1 if any of these numbers come up.

Six Line Bet

This is betting that one of six numbers in two adjacent rows will come up. Place a chip in between two rows on the outside line. If the ball lands on any number in the two rows, you will be paid 6 to 1.

Outside Bets

Red

You are betting that the next number to come up is a red. If the next number landed is red, you will be paid 1 to 1, or even money. To play this bet, place a chip on the box marked "Red".

Black

You are betting that the next number to come up is a black. If the next number landed is black, you will be paid 1 to 1, or even money. To play this bet, place a chip on the box marked "Black".

Even

This is wagering that the ball will land on an even number. This bet does not include 0 or 00. The payoff is 1 to 1. To play this bet, place a chip on the box marked "Even".

Odd

This is wagering that the ball will land on an odd number. The payoff is 1 to 1 if the next number to come up is odd. To play this bet, place a chip on the box marked "Odd".

Low Bet

This is a bet that the next number will be between 1 and 18. The payout is 1 to 1. To play this bet, place a chip on the box marked "Low".

High Bet

This is a bet that the next number will be between 19 and 36. The payout is 1 to 1. To play this bet, place a chip on the box marked "High".

Dozen Bet

These bets divide the table into the numbers 1-12, 13-24, and 25-36. To play this bet, put a chip in one of the three boxes marked "1st 12", "2nd 12" or "3rd 12". This bet pays 2 to 1.

Column Bet

This bets that a number in a particular column will come up on the next spin. The payoff is 2 to 1 and is done by placing a chip at the end of the layout below your desired column where it is marked "2 to 1".

English Roulette

The major difference between English and American Roulette is that English has only a 0 instead of both 0 and 00.

Sic Bo

Sic Bo is an ancient Chinese game meaning 'Dice Pair'. It is played in Southeast Asia, Korea, Nevada and Australia. It is also popular in the Philippines, where it is called 'Hi-Lo'. Sic Bo is played with three dice. The object of the game is to select the individual numbers, or combinations of numbers, that will appear on the dice after the 'throw'.

The possibilities include single dice numbers, two of a kind, three of a kind, or combinations of any two or three of the dice. These are displayed along with payoff odds on the table's layout.

To start, the players make their selection of a possible outcome and place a bet on a chosen possibility. After the bets are made, the dice tumbler is rotated and then set on the table. All winning possibilities of the three dice appear illuminated on the layout.

Winning payoffs range from 1:1 even money for one-of-a-kind, to 180:1 for a specific trio.

Jackpot

The method and system described herein provide a method for jackpot betting, Paradise Jackpot™ The players of the live baccarat game or a felt table game can make a separate bet for jackpot. The jackpot bet can be placed with a bet for live baccarat or felt table game or without a bet for the same live baccarat felt table game.

In some embodiments, the outcome of the jackpot betting is determined by the combination of cards that includes zero-point or non-zero-point cards. The combination includes at least one zero-point cards, which are 10,J,Q and K. In one embodiment, the rules for playing Paradise Jackpot™ are described below:

(1) The gaming system provides a jackpot. Players who wish to bet on the Paradise Jackpot™ can place a separate bet, e.g. HKD 20 per game in minimum, which will be referred to as bet unit. The maximum number of bet units will not be restricted.

(2) Players can bet in Paradise Jackpot™ without placing bet in the same live baccarat game. Each player can place more than one bet unit in one game. When the Paradise Jackpot™ is won, the payout for each bet unit will be equal to the money in the Paradise Jackpot™ pool divided by the total number of bet unit.

(3) If the first 5 cards drawn in one baccarat game resulting in A,K,Q,J,10 in spade, regardless of the sequence, then 100% of the Paradise Jackpot™ is won.

(4) If the first 5 cards drawn in one baccarat game resulting in K,Q,J,10 in spade and A in either heart, club or diamond, regardless of the sequence, then 10% of the Paradise Jackpot™ is won. In some embodiments, the winning combinations for 10% of the jackpot can be any of the following Spade A plus K,Q,J,10 in Heart, Club or Diamond;

Heart A plus K,Q,J,10 in Spade, Club or Diamond;

Club A plus K,Q,J,10 in Spade, Heart or Diamond; or

Diamond A plus K,Q,J,10 in Spade, Heart, or Club.

In some other embodiments, the Paradise Jackpot™ can be played according to Rules (I)-(III), defined below:

(I) The Paradise Jackpot™ is won if any of the following is met:

1) any five cards forming a sequence, regardless of the order they are drawn, e.g., A,2,3,4,5 or 9,10,J,Q,K;

2) five cards of a kind, e.g. A,A,A,A,A or K,K,K,K,K;

3) four cards of a kind, regardless of the order they are drawn, e.g., K,K,K,K,2 or 2,K,K,K,K;

4) three cards of a kind plus a pair, regardless of the order they are drawn, e.g., 10,10,10,2,2;

5) three cards of a kind, regardless of the order they are drawn, e.g., 2,2,2,10,J 6) two pairs, regardless of the order they are drawn, e.g., Q,Q,2,K,K;

7) all the 5 cards of the same symbols (same suit): spade, heart, club or diamond, e.g., A(spade),10(spade),J(spade),K (spade),Q(spade); or 8) any specific combination of five cards as specified from time to time.

(II) The Paradise Jackpot™ is won by any specific combination of the first four, three or two cards drawn in a live baccarat game, with regard to/regardless of the drawn sequence. Specifically, the Paradise Jackpot™ is won if any of the following is met:

(A) if the first four cards that are drawn form a combination as defined below:

1) the first four cards forming a sequence, with regard to/regardless of the order they are drawn, e.g., A,2,3,4, or 10,J,Q,K;
2) the first four cards of a kind, e.g. A,A,A,A or J,J,J,J;
3) three cards of a kind, with regard to/regardless of the order they are drawn, e.g., K,K,K,2 or 10,10,10,2;
4) two cards of a kind plus a pair, with regard to/regardless of the order they are drawn, e.g., 2,2,J,J, which is a two pair sequence;
5) two cards of a kind, with regard to/regardless of the order they are drawn, e.g., 10,10,Q,Q;
6) all the four cards of the same symbols (same suit): spade, heart, club or diamond, e.g., A(spade),10 (spade),J(spade),K(spade); or
7) any specific combination of the first four cards as specified from time to time, (B) if the first three cards that are drawn form a combination as defined below:

1) the first three cards forming a sequence, with regard to/regardless of the order they are drawn, e.g., A,2,3, or 10,J,K;
2) the first three cards of a kind, e.g. A,A,A or 2,2,2;
3) two cards of a kind, with regard to/regardless of the order they are drawn, e.g., K,K,2 or 10,10,2;
4) two cards forming a pair, with regard to/regardless of the order they are drawn, e.g., 2, J,J or J,J,2;
5) all the three cards of the same symbols (same suit): spade, heart, club or diamond, e.g., A(spade),J(spade), K(spade); or
6) any other specific combination of the first four cards as specified from time to time, or (C) if the first two cards that are drawn form a combination as defined below:

1) the first two cards forming a sequence, with regard to/regardless of the order they are drawn, e.g., A,2, or J,Q;
2) the first two cards of a kind, e.g. A,A or 10,10, which is also a pair;
3) the first two cards of the same symbols (same suit): spade, heart, club or diamond, e.g., A(spade),10 (spade); or
4) any other specific combination of the first four cards as specified from time to time.

(III) The Paradise Jackpot™ is won by any specific combination of the last six, five, four, three, and two cards drawn in a live baccarat game, with regard to/regardless of the drawn sequence. Specifically, the Paradise Jackpot™ is won if any of the following is met:

(A) if the last six cards that are drawn form a combination as defined below:

1) the last six cards forming a sequence, with regard to/regardless of the drawn sequence they are drawn, e.g., A,2,3,4,5,6 or 8,9,10,J,Q,K;
2) six cards of a kind, e.g. A,A,A,A,A,A or 2,2,2,2,2,2;
3) five cards of a kind, with regard to/regardless of the order they are drawn, e.g., K,K,K,K,K,2 or 2,10,10,10, 10,10;
4) four cards of a kind, with regard to/regardless of the order they are drawn, e.g., K,K,K,K,2,10 or 2,A,J,J,J,J;
5) four cards of a kind plus a pair, with regard to/regardless of the order they are drawn, e.g., K,K,K,K,2,2 or 2;$^{4}$2, J,J,J,J;
6) three cards of a kind plus a pair, with regard to/regardless of the order they are drawn, e.g., 2,2,2,J,J,A or J,J,2,2,2,K;
7) three cards of a kind, with regard to/regardless of the order they are drawn, e.g., A,A,A,10,J,K or 10,J,K,2, 2,2;
8) three pairs, with regard to/regardless of the order they are drawn, e.g., Q,Q,K,K,J,J or 2,2,10,10,K,K;
9) all the six cards of the same symbols (same suit): spade, heart, club or diamond, e.g., A(spade),10(spade),J (spade),K(spade),Q(spade),2(spade); or
10) any other specific combination of six cards as specified from time to time.

(B) if the last five cards that are drawn form a combination as defined below:

1) the last five cards forming a sequence, with regard to/regardless of the order they are drawn, e.g., A,2,3,4,5 or 9,10,J,Q,K;
2) five cards of a kind, e.g. A,A,A,A,A or 2,2,2,2,2;
3) four cards of a kind, with regard to/regardless of the order they are drawn, e.g., K,K,K,K,2 or 2,10,10,10,10;
4) three cards of a kind plus a pair, regardless of the order they are drawn, e.g., 2,2,2,J,J;
5) three cards of a kind, regardless of the order they are drawn, e.g., 2,2,2,10,Q;
6) two pairs, regardless of the order they are drawn, e.g., Q,Q,A,10,10;
7) all the 5 cards of the same symbols (same suit): spade, heart, club or diamond; e.g., A(spade),10(spade),J (spade),K(spade),Q(spade); or
8) any other specific combination of five cards as specified from time to time, (C) if the last four cards that are drawn form a combination as defined below:

1) the last four cards forming a sequence, with regard to/regardless of the order they are drawn, e.g., A,2,3,4, or 10,J,Q,K;
2) the last four cards of a kind, e.g. A,A,A,A or 10,10, 10,10;
3) three cards of a kind, with regard to/regardless of the order they are drawn, e.g., K,K,K,2 or 10,10,10,2;
4) two cards of a kind plus a pair, regardless of the order they are drawn, e.g., A,A,J,J, which is a two pair sequence;
5) two cards of a kind, regardless of the order they are drawn, e.g., 2,2,Q,Q;
6) all the four cards of the same symbols (same suit): spade, heart, club or diamond, e.g., A(spade),10 (spade), K(spade),Q(spade); or
7) any other specific combination of the first four cards as specified from time to time, (D) if the last three cards that are drawn form a combination as defined below:

1) the last three cards forming a sequence, with regard to/regardless of the order they are drawn, e.g., A,2,3, or J,Q,K;
2) the last three cards of a kind, e.g. A,A,A or Q,Q,Q;
3) two cards of a kind, with regard to/regardless of the order they are drawn, e.g., K,K,2 or 10,10,2;

4) two cards forming a pair, with regard to/regardless of the order they are drawn, e.g., 2, J,J or J,J,2;
5) all the last three cards of the same symbols (same suit): spade, heart, club or diamond, e.g., A(spade),J(spade), K(spade); or
6) any other specific combination of the first four cards as specified from time to time, (E) if the last two cards that are drawn form a combination as defined below:

1) the last two cards forming a sequence, with regard to/regardless of the order they are drawn, e.g., A,2, or 10,J;
2) the last two cards of a kind, e.g. A,A or 2,2, which is also a pair;
3) the last two cards of the same symbols (same suit): spade, heart, club or diamond, e.g., A(spade),10 (spade); or
4) any other specific combination of the first four cards as specified from time to time.

In some embodiments, according to a further jackpot rule of the present invention, the Paradise Jackpot™ is won if cards drawn in a live baccarat game or felt table game are 5 cards of a kind or 6 cards of a kind. For example, the 5 or 6 cards of a kind can be in one dealer's hand, irrespective of suits or respective of suits. For example, the 5 or 6 cards can all carry number 8 irrespective of suites, or the 5 or 6 cards can all be of Jack irrespective of suits.

The combinations of cards not defined above can be readily derived from time to time with or without the assistance of a computer following established rules of forming combinations of a set of defined members. The amount of Paradise Jackpot™ award can be determined by and distributed according to, e.g. the probability of a combination of cards as defined above or otherwise specified from time to time.

There may be more than one live baccarat game going on simultaneously in different casinos in Macau. In some embodiments, all Paradise Jackpot™ bets from different live baccarat tables will contribute to one grand Paradise Jackpot™ pool. If the Paradise Jackpot™ is won in any one live baccarat table, all players who place Paradise Jackpot™ bets, regardless of the live baccarat table they bet, will share the grand Paradise Jackpot™ pool according to the bet units that each player placed in the jackpot betting.

Paradise Jackpot™ can be played with bets from players as the sole source of the jackpot pool or with bets and an initial contribution from the banker. The term "banker" generally refers to the owner of a gaming establishment operating the live baccarat defined herein or one who operates the live baccarat game. In one embodiment, the banker contributes a sum of money as the initial Paradise Jackpot™ (e.g., HKD 50,000). A certain percentage, e.g., 55%, of the Paradise Jackpot™ bets from the players will be contributed towards the Paradise Jackpot™ pool, a certain percentage (e.g., 40%) of the bets will be collected by the banker as profit, and the remaining portion (e.g., 5%) of the bets will be accumulated as the seed for the next game.

An embodiment of the general gaming method described herein is shown in the flowchart in FIG. 1. The flowchart shows the steps in playing the live baccarat games described herein. Step 110 shows the baccarat is ready to start a game. In step 120, the dealer presses the Start button on the baccarat machine to count-down the time for accepting bets. In step 130, the betting terminal, BU, accepts bets. Step 140 shows that the time for accepting bets is over and the dealer press the Cut-off button on the machine. In step 150, the server, which is also referred to as betting computation and track record central processing unit (BCPU), receives all bets from betting terminals. The dealer then obtains and displays cards in step 160. In step 170, the baccarat game gives results and the dealer presses approve button, approving the card dealing made, game results and payouts. The server, BCPU, then computes and distributes wins in step 180. The live baccarat game is over, as shown in step 190, and the machine is ready for next round of baccarat game that begins with step 110.

In another aspect of the present invention, it is provided a software program or a set of software programs that allows a user or player to any or all of the various aspects of playing the live baccarat Paradise Jackpot™ described herein. The software program can be written by one of ordinary skill in the art.

Gaming System

Figure 2:
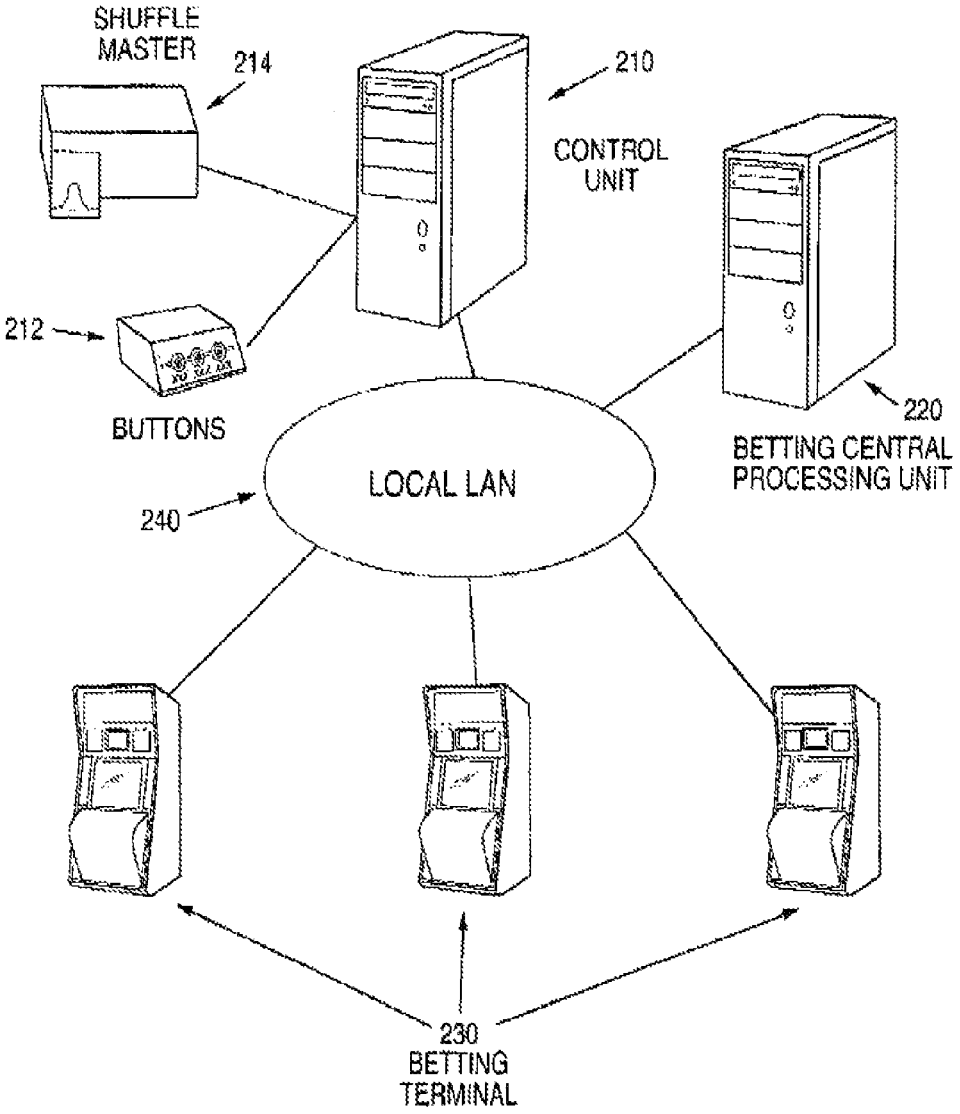
FIG. 2 shows a system embodying live baccarat jackpot of the present invention.

One aspect of the present invention provides a baccarat gaming system that allows one to play the live baccarat jackpot described herein. One embodiment of the present invention is shown in FIG. 2. Referring FIG. 2, the baccarat gaming system includes three members: (1) the control unit for automatic shuffle mechanism (CU) (210), (2) betting computation and tract record central processing unit (BCPU) (220), and (3) betting terminal for players (BT) (230) (FIG. 2). The control unit 210 may further contain control buttons (212) that allows the dealer to control the shuffling mechanism, which can be manual or automatic, and/or a shuffle master (214), which can be manual or automatic, for shuffling the cards. The CU 210 can include any or all of the components which may include control buttons that allow input from dealer and/or capable of (1) receiving the shuffle mechanism input, (2) sending visual output to a screen, and/or (3) sending card results in the player hand and/or bank hand to BCPU 220. The BCPU 220 has components or members capable of performing any or all of (1) receiving betting from BT (230), (2) receiving card results from CU 210, (3) sending betting results to BT 230, and/or (4) sending credit to BT 230.

The betting terminal for players, BT 230, has components or members capable of performing any or all of (1) sending betting to BCPU 220, (2) receiving betting results from BCPU 220, and/or (3) receiving credit from BCPU 220. Note, the baccarat gaming system can have a number of betting terminals, depending on the need of a gaming establishment. For example, if desirable, the baccarat gaming system can have 1, 2, 3, 4, 5, 6, 7, 8, 9, or 10, up to, e.g., 50 or 250 BTs. CU 210, BCPU 220, and BT 230 can be linked together via a local area network (LAN) (240) to form a baccarat gaming network between one, two, three or several gaming establishments.

The live baccarat game can have different variations. For example, the game can be played separately as a single live baccarat game. In some embodiments, the individual baccarat games as played in each betting terminal can be linked together. The individual games can all be played in a casino or gaming establishment or in several casino or gaming establishments. The individual games played in different betting terminals can be the same or different. Therefore, some or all of the baccarat games played in individual betting terminals, which can be the same or different baccarat games, can be linked together for a single jackpot.

Figure 3:
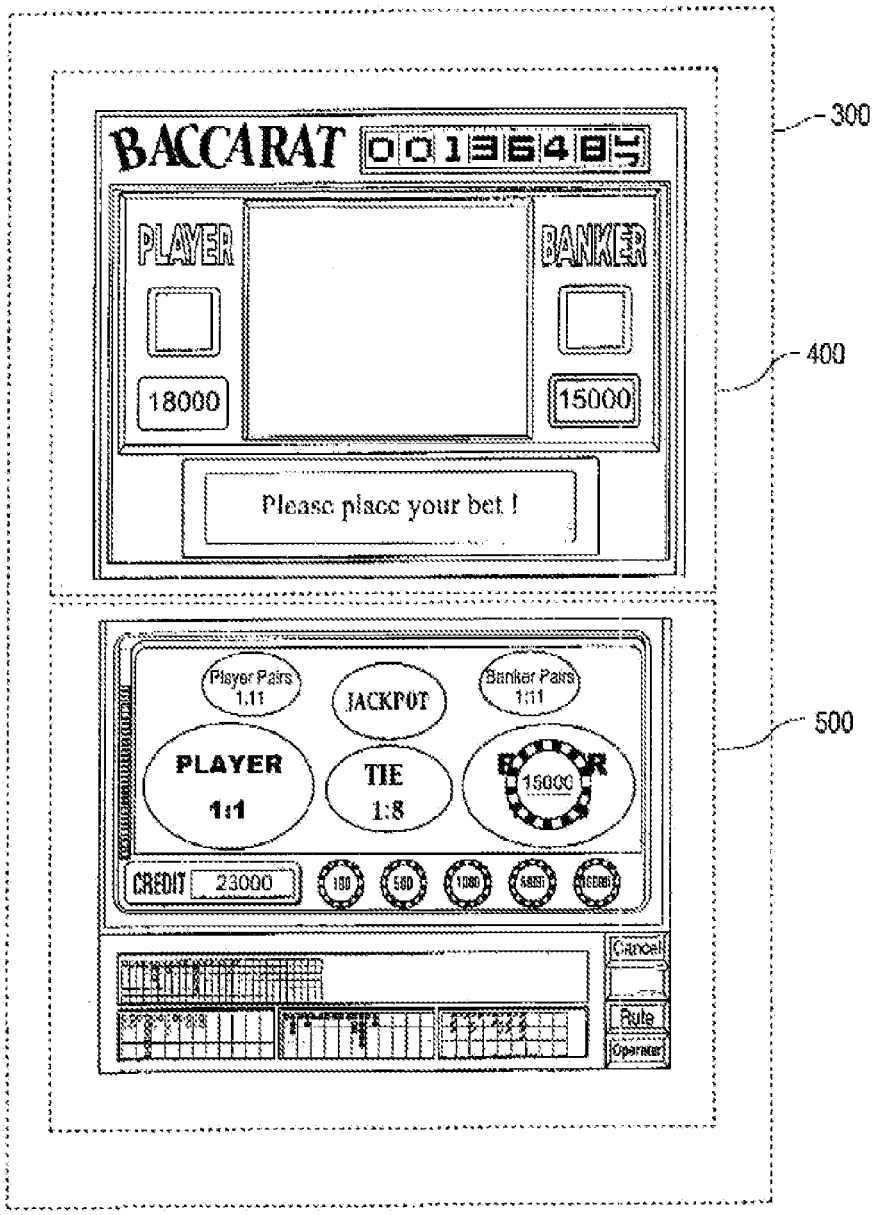
FIG. 3 shows the general layout of a baccarat machine.

A layout for the live baccarat game described herein is shown in FIGS. 3, 4A and 4B. FIG. 3 shows the overall layout of the betting terminal (300), which has two screens, the upper screen (400) and the lower screen (500), shown in detail in FIGS. 4 and B. Referring to FIG. 4A, upper screen 400 includes an upper part (410) for displaying the result, score and latest jackpot amount, the center part (420) for displaying a live video of the gambling table, and a messenger screen (430) for displaying messages. In one embodiment, the jackpot amount digits can be programmed to be in rolling motion to reflect the increasing jackpot pool. The center part of the upper screen has a section designated as Player (440), which has a small screen (450), and another section designated as Banker (460), which also has a small screen (470). The small screens 450 and 470 are for display of card values of the player hand and the bank hand respectively. The current limits available for betting on Player (player hand) and Banker (bank hand) in a live baccarat game are shown in small screens 480 and 490 below small screens 450 and 470, respectively.

Referring to FIG. 4B, the lower screen 500 is an operating touch screen for betting, which includes bet-option buttons (510), bet-amount buttons (520), and credit window (530). The bet-option buttons 510 include the various betting selections described above, e.g., betting for player hand (511) win with a payoff rate of 1:1, for the bank hand (512) win with a payoff rate of 1:0.95, for tie (513) with a payoff rate of 1:8, for Player Pairs (514) with a payoff rate of 1:11, for banker pairs (515) with a payoff rate of 1:11, and for Jackpot bet (516), the rules of which are described above. Box 517 shows the pops up when bets are placed on a particular bet option. The number inside Box 517 corresponds to the amount placed on a particular bet option. The bet-amount buttons 520 as shown in the layout, 100, 500, 1000, 5000, 10000, provide the players the convenience of adding up betting amounts in a fast manner. To illustrate, for a bet of 10,000 USD or HKD, the player can simply press the "1000" button ten times to reach the desired betting amount. Note, the bet-amount buttons 520 shown are illustrative and nonexclusive. Buttons designated for other amounts, e.g., "1", "5", "10", "100", "100,000", "1,000,000" can be readily added to the screen. The credit window 530 shows the remaining balance of a player's credit. The player may insert bills or chips into or transfer money from a credit card account and/or a bank account to the machine to add up the credit amount from time to time. If the player desires to stop playing the baccarat game and to cash out, he may ask the operator to authorize a cash-out procedure, and then obtain the remaining balance.

Still referring to FIG. 4, the lower screen 500 further includes language selection button (540), which can switch the operation language of the baccarat game between, e.g., English, Portuguese, Italian, French, Spanish, Russian, German, Arabic, Japanese, and Korean, etc, Rule selection button (550), which prompts the display of rules for live baccarat and Paradise Jackpot™, Cancel button (560), which allows the bettor to cancel all bets made before the cards are dealt, Operator button (570), which allows the bettor to call for assistance from the casino staff when there is machine failure or the bettor wishes to exit from the game, and Results Bars (580, 590) which display the results for previous live baccarat games. Once results of a game are confirmed, the losing bet shown in the bet option buttons (510) in the center of lower screen will disappear while the winning bet in the bet option buttons (510) in the lower screen will flash with the total amount won.

Figure 4C:
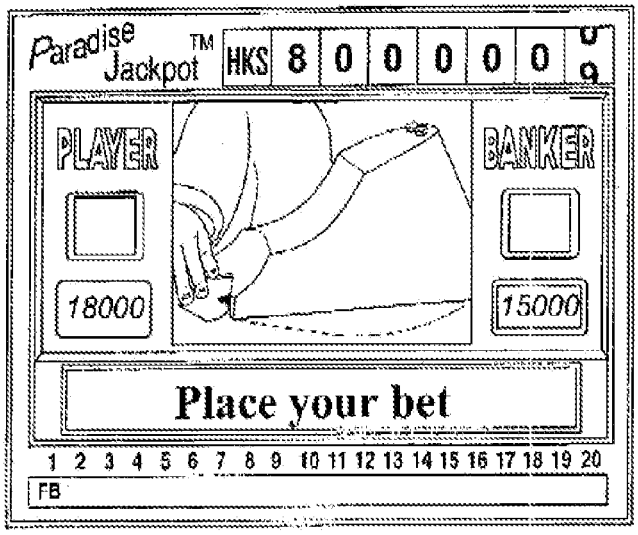
FIGS. 4C and 4D show a variant of the layout of the betting terminal shown in FIGS. 4A and 4B.

FIG. 4C is an alternative design of the upper screen 400 as shown in FIG. 4A, which has a similar layout as the one shown in FIG. 4A except that the top right corner of the upper screen displays the words "Paradise Jackpot™" and the bottom rim has a blank bar and numbers 1 through 20 on top of the bar.

Figure 4D:
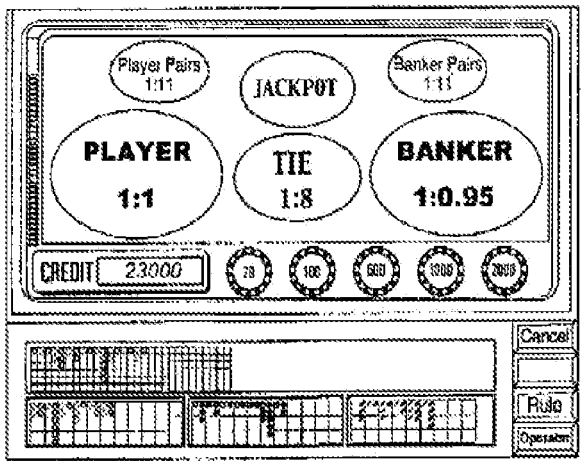

FIG. 4D is an alternative design of the lower screen of 500 as shown in FIG. 4B, which as a similar layout as the one shown in FIG. 4B except that the top rim of the lower screen 500 bears letters indicating the left side as the Player side and the right side and the Banker side, a screen at the far up-left corner indicating the maximum bet on the player hand accepted by the dealing table in a game, and a screen at the far up-right corner indicating the maximum bet on the banker hand accepted by the dealing table in a game.

Figure 5:
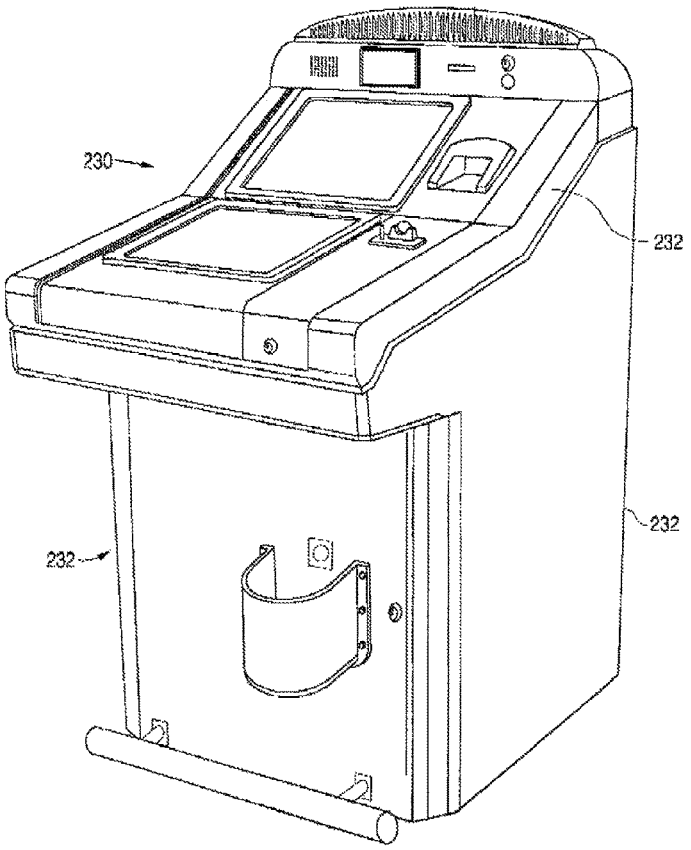
FIG. 5 shows an embodiment of the overall design of the betting terminal.
Figure 6:
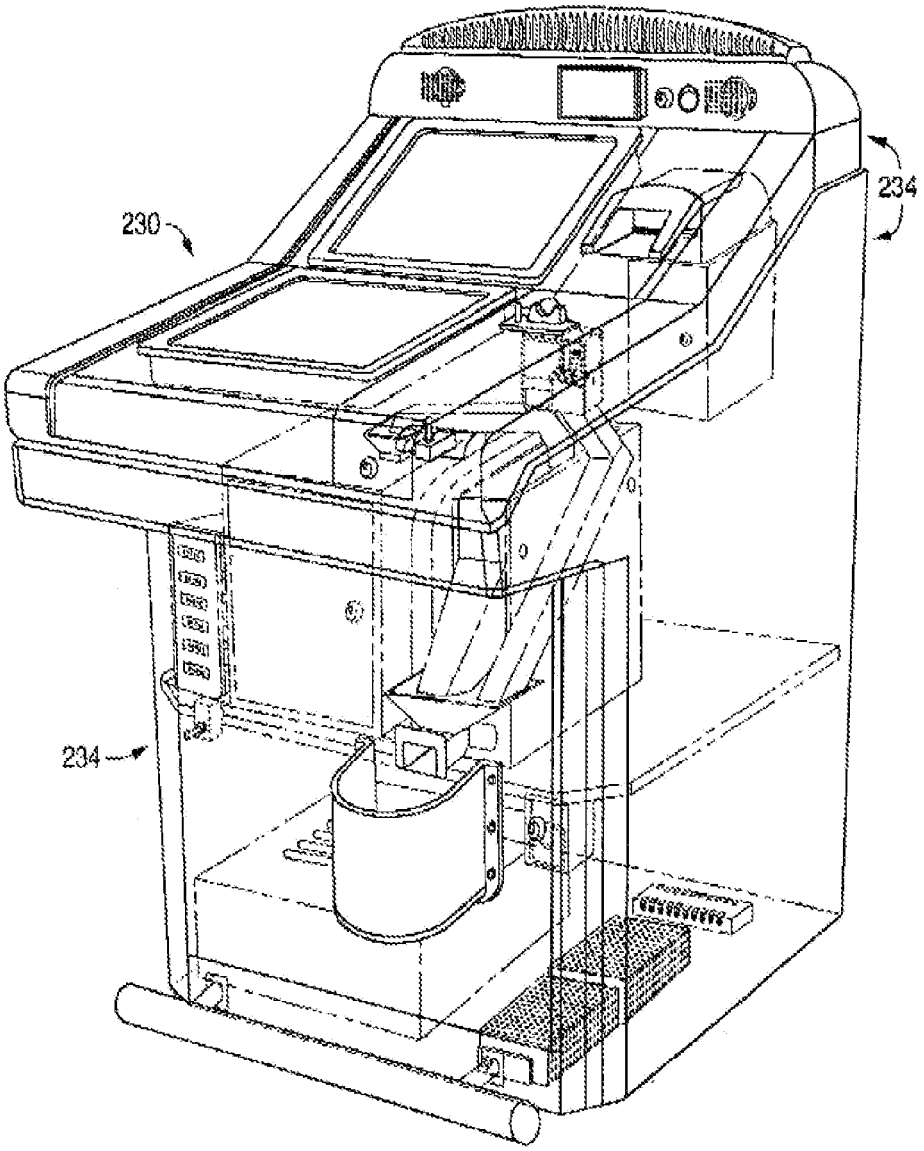
FIG. 6 shows another embodiment of the overall interior design of the betting terminal.

FIGS. 5 and 6 show two embodiments of the betting terminal (BT) 230. FIG. 5 shows an embodiment of BT 230 that has an opaque cover 232. FIG. 6 shows an embodiment of the interior design of BT 230.

Figure 7:
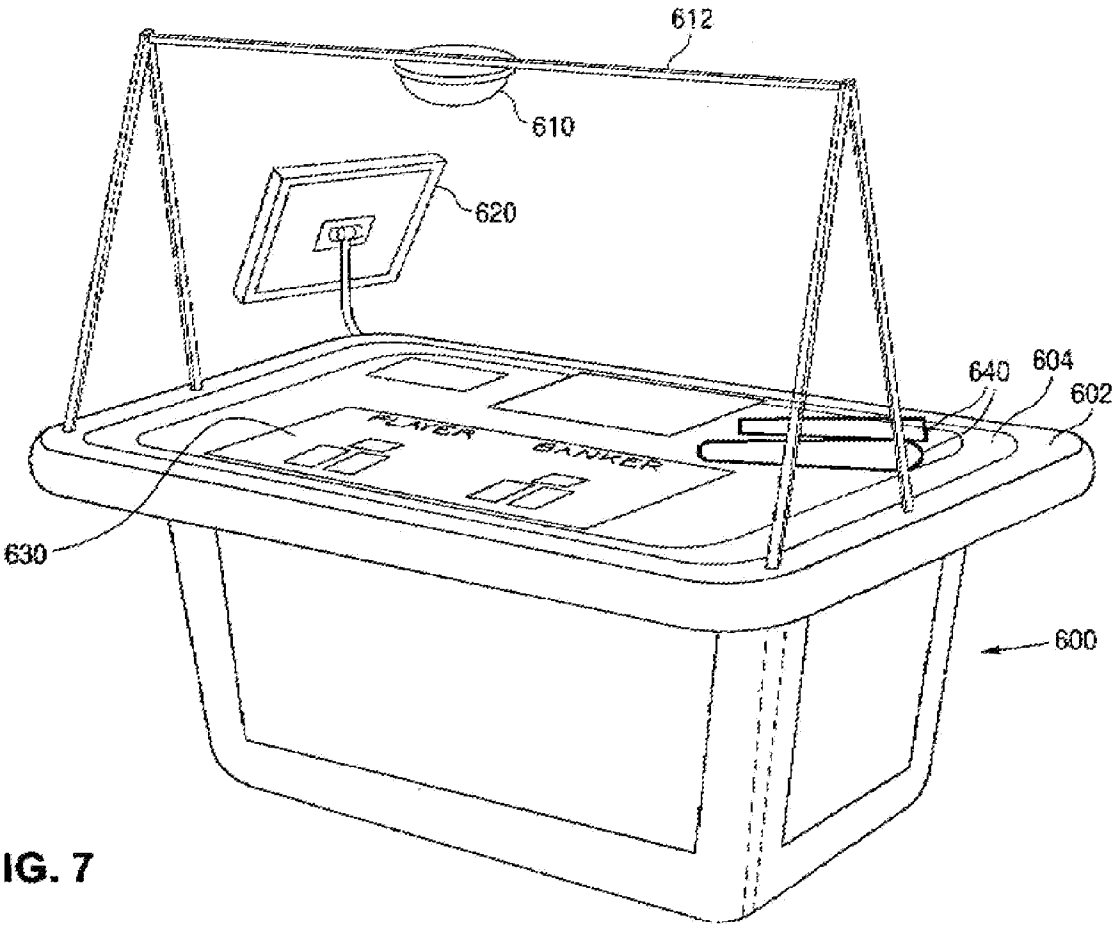
FIG. 7 shows an embodiment of the design of the dealing table.

In some embodiments, the gaming system includes a dealing table. An embodiment of the dealing table is shown in FIG. 7, which includes a main body 600, an overhead video camera 610 supported by a handle 612, a signaling mechanism (e.g., a touch screen) 620 for prompting the dealer of the dealing process, a lighting mechanism 630 for indication of the order the card dealing process, and rings 640 marking the space for placing the card shuffle master and box for disposal of played cards. The main body 600 has an outer rim 602 and inner rim 604.

Figure 8:
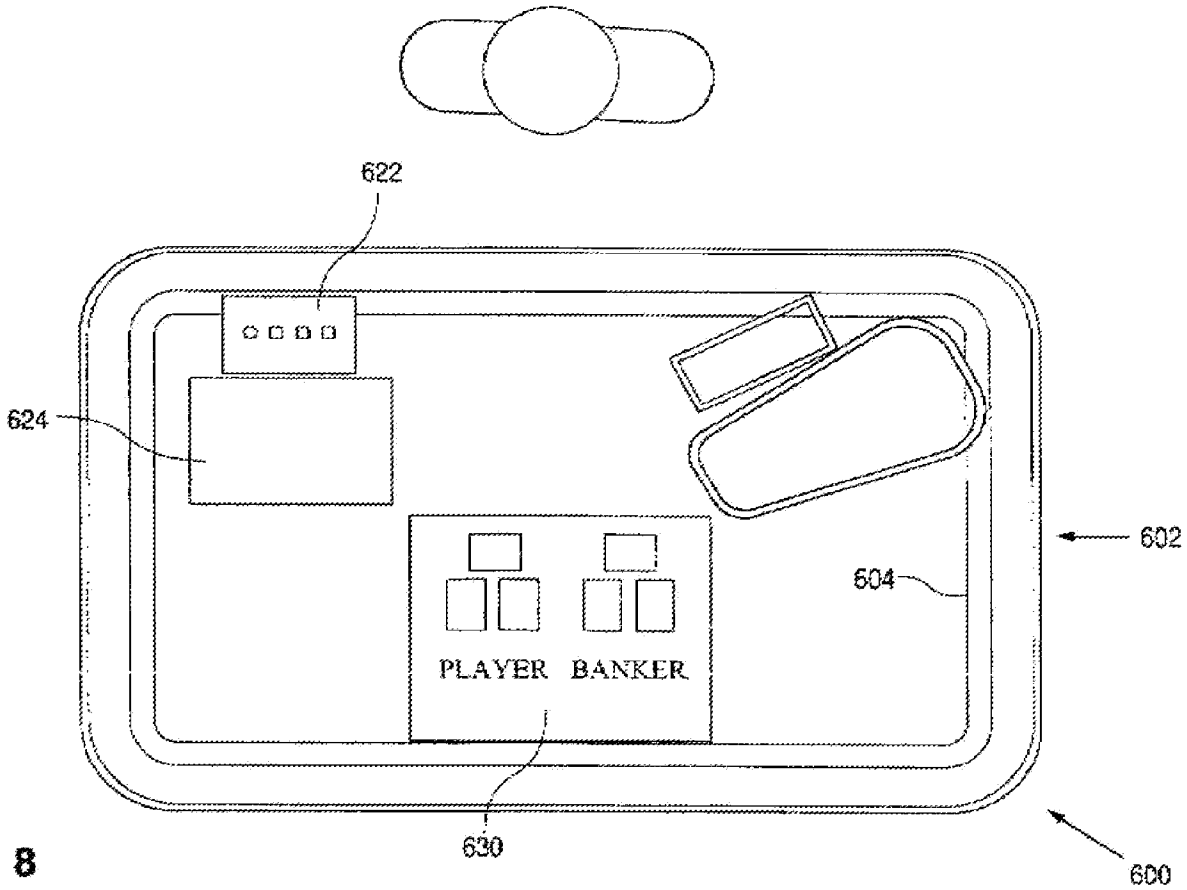
FIG. 8 shows an embodiment of the layout of the dealing table.

Another embodiment of the dealing table is shown in FIG. 8, which has a main body (DT 600), a touch screen 620 that includes a screen 622 and a pop up mechanism 624 for the touch screen, a lighting mechanism 630, and rings 640 marking the space for placing the card shuffle master and box for disposal of played cards. The main body 600 has an outer rim 602 and inner rim 604. In one embodiment, the main body 600 of the dealing table shown in FIG. 8 has an overall dimension of 1600 mm×1000 mm, the outer rim having an outer dimension of 1600 mm×1000 mm and an inner dimension of 1440 mm×840 mm, and the inner rim having an outer dimension of 1440 mm×840 mm and an inner dimension of 1350 mm×750 mm. The touch screen 620 includes a screen 622 having a dimension of 220 mm×130 mm and a pop up mechanism 624 having a dimension of 275 mm. The lighting mechanism has a dimension of 500 mm×400 mm.

Figure 9A:
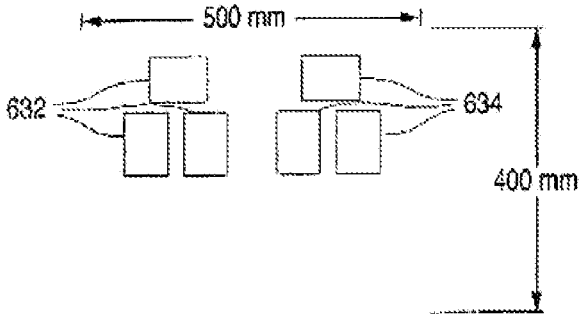
FIG. 9A shows an embodiment of the layout of the dealing table having lights indicating the order of the card dealing process.

FIG. 9 shows an embodiment of the lighting mechanism 630 of the dealing table as shown in FIG. 7 or 8. The lighting mechanism 630 includes lighting 632 indicating the next card shall be dealt to the Player and lighting 634 indicating the next card shall be dealt to the Banker. In one embodiment, the lighting mechanism can have a dimension of 500 mm×400 mm.

Figure 10:
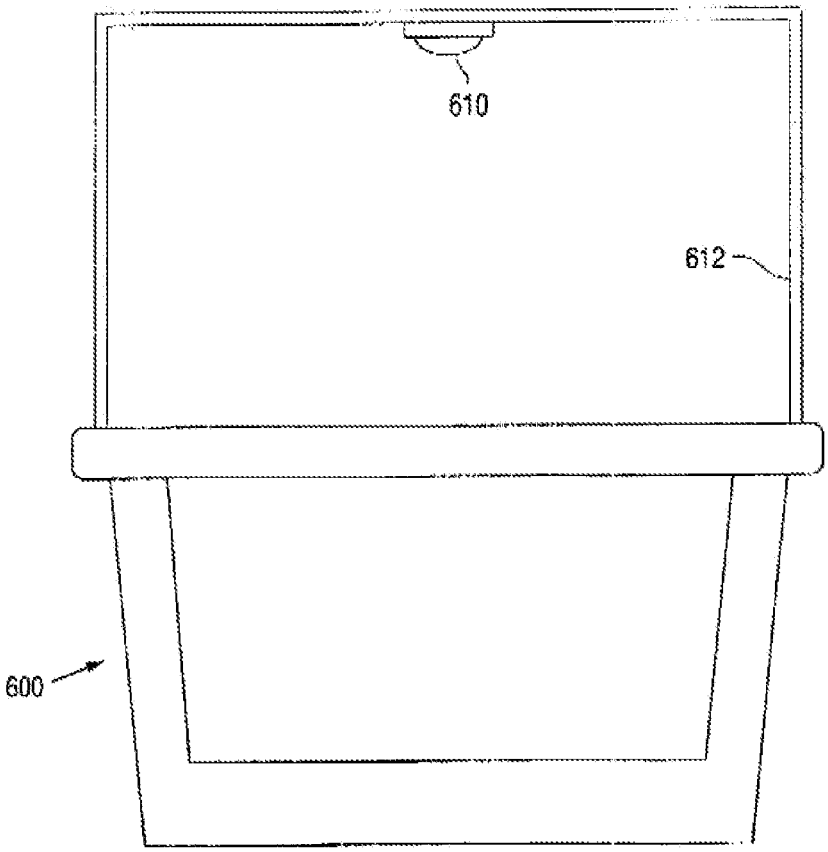
FIG. 10 shows the side view of a design of the dealing table.

FIG. 10 shows a side view of an embodiment of the dealing table of the present invention, which shows the main body 600 and the overhead video camera 610 supported by handle 612. In one embodiment, the main body 600 can have a length of 1600 mm and a height of 850 mm, and handle 612 can have a height of 850 mm.

Figure 11:
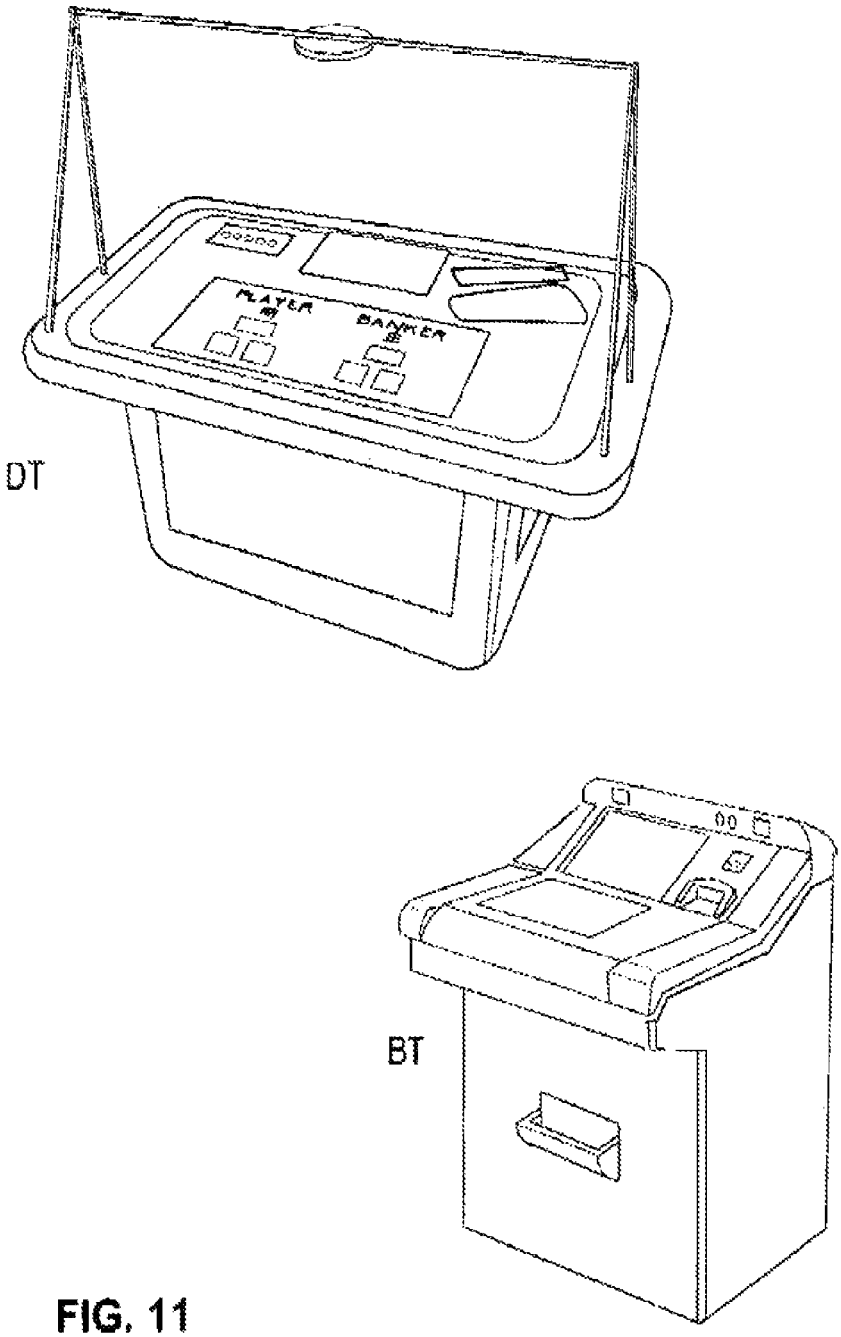
FIG. 11 shows an embodiment of the overall layout of betting terminals and the dealing table.
Figure 12:
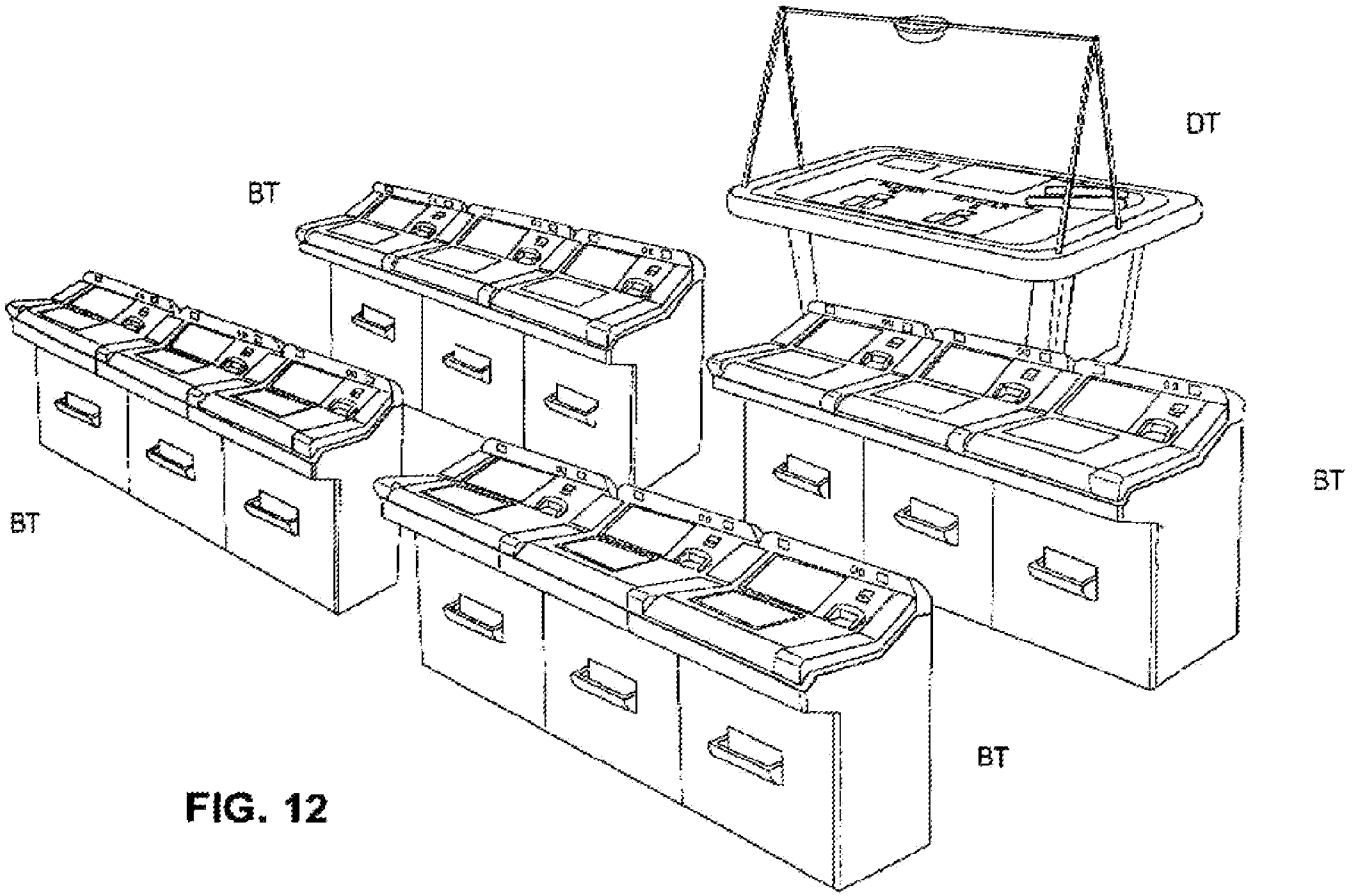
FIG. 12 shows an embodiment of one design of the Live Baccarat of present invention.
Figure 13:
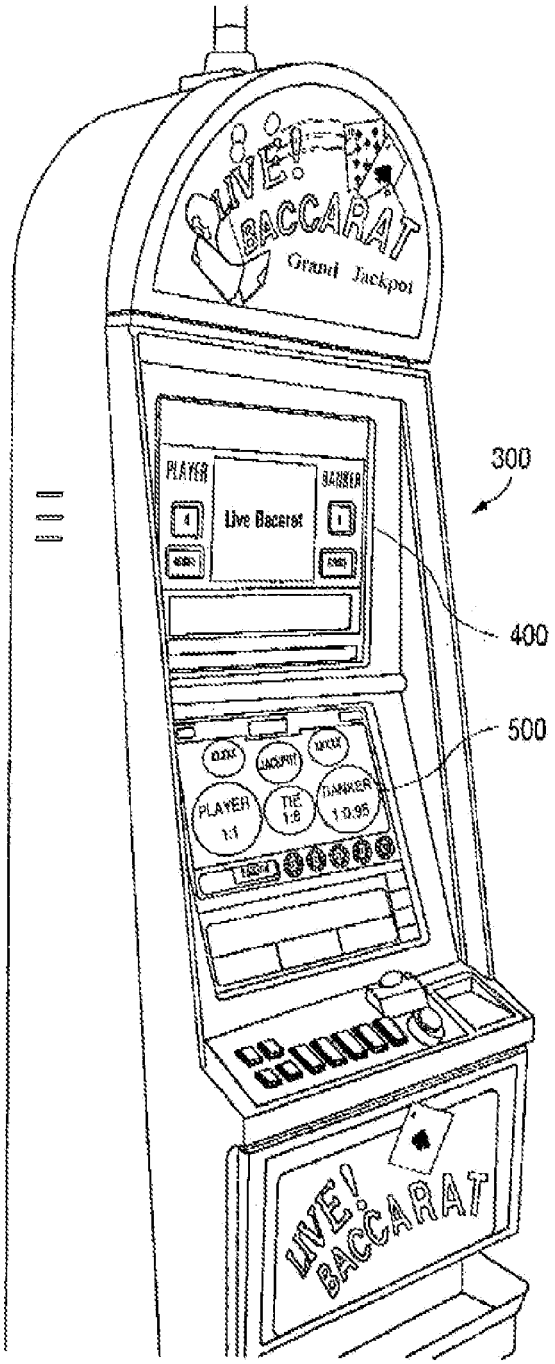
FIG. 13 shows an embodiment of another design of the Live Baccarat betting terminal of the present invention.

FIG. 11 shows an embodiment of the gaming system of the present invention that includes a dealing table and a betting terminal. FIG. 12 shows the overall layout of an embodiment of the gaming system of the present invention, which includes a dealing table and a plurality of betting terminals. FIG. 13 shows the overall layout of a further embodiment of the gaming system of the present invention.

In some other embodiments, the baccarat jackpot game can be played in an entertainment setting, e.g., in the form of game device such as laptop or desktop computers.

In a further embodiment, the baccarat jackpot game can be played in a non-baccarat game, e.g., blackjack, or showhand. The rules of these games other than baccarat games are known to one in the art.

Figure 14:
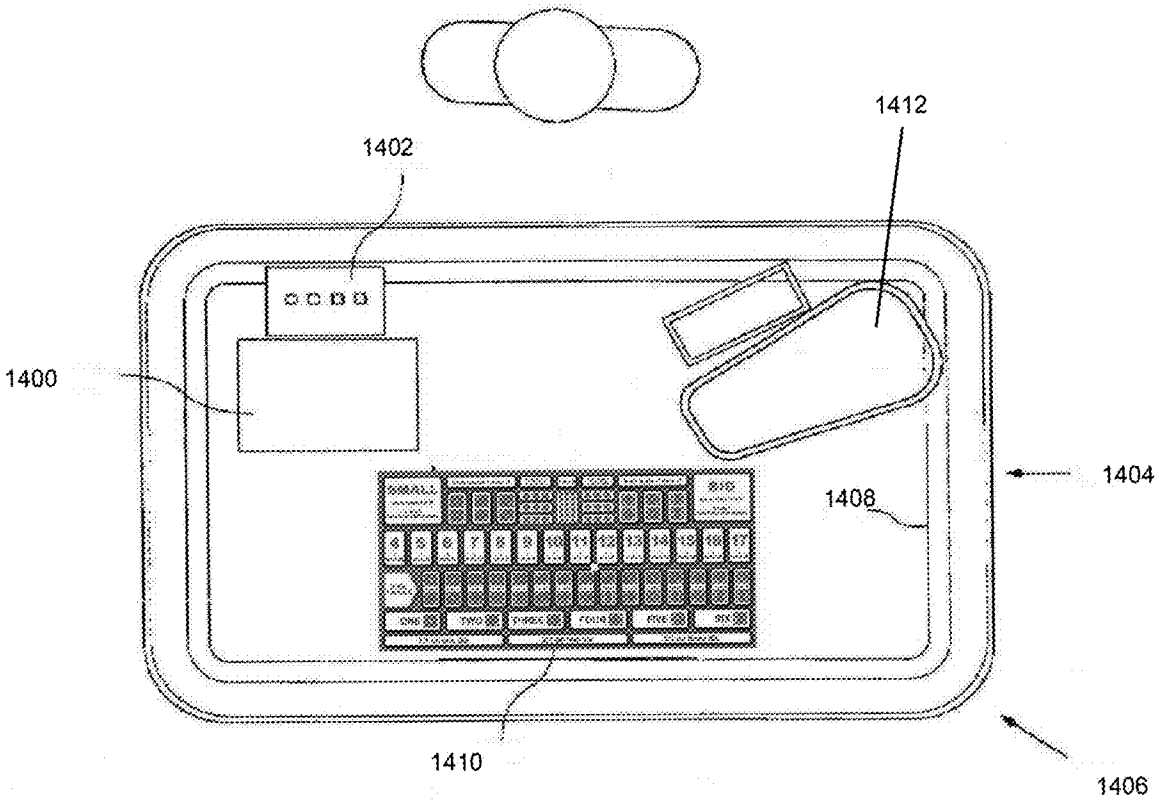
FIGS. 14-15 show an embodiment of the present invention with the game being Sic Bo.
Figure 15:
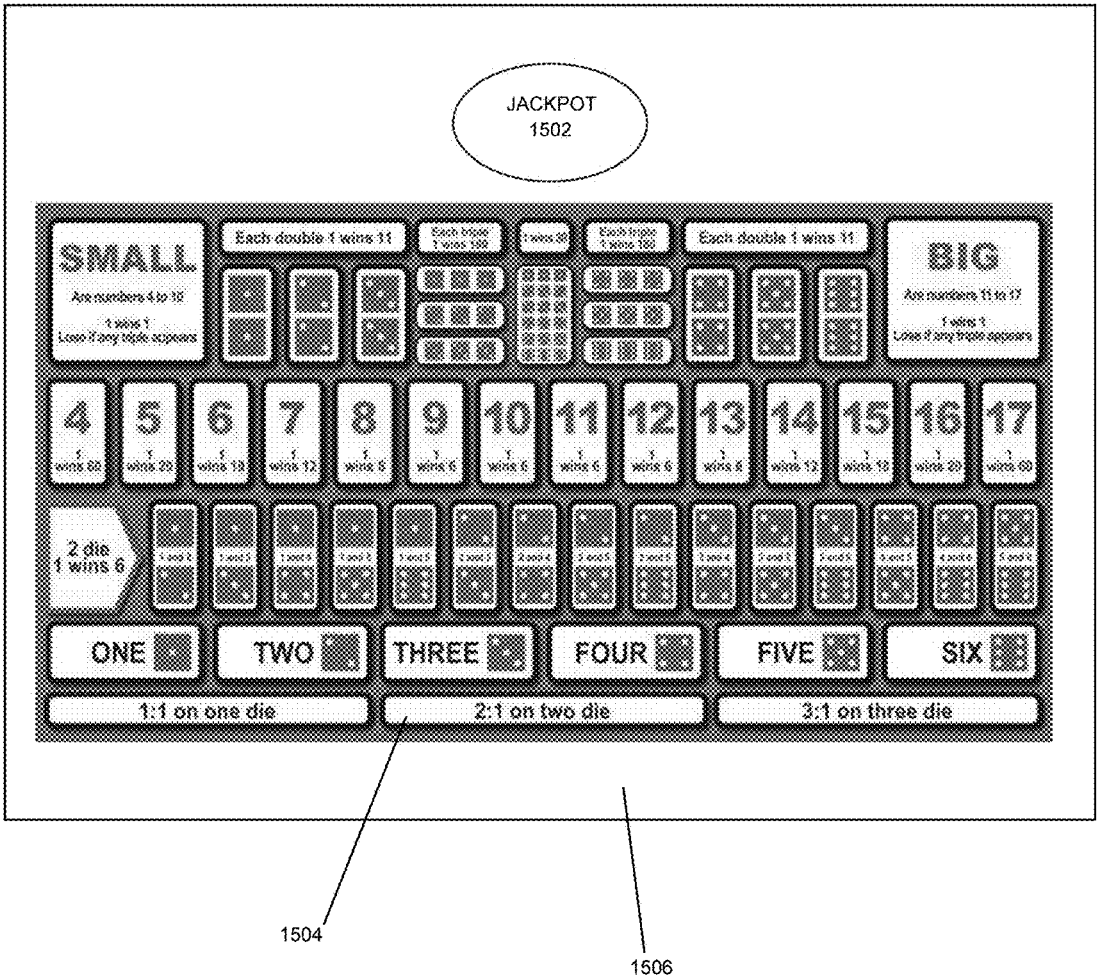

Another embodiment of the dealing table is shown in FIGS. 14-15, which has a main body (Sic Bo felt table game 1406), a touch screen that includes a screen 1402 and a pop up mechanism 1400 for the touch screen, a lighting mechanism and rings 1412 marking the space for placing the card shuffle master and box for disposal of played cards. The felt table game 1406 has an outer rim 1404 and inner rim 1408. A method of playing a felt table game 1406 is claimed which allows a player to bet on a jackpot, the method comprising: Playing a Sic Bo felt table game (1406) according to a set of conventional rules, allowing at least a first player to place a bet on the Sic Bo felt table game (1406), allowing at least a second player to place a bet on the jackpot at a betting terminal (1506) where the second player can be the same as or different from the first player, determining the outcome of the Sic Bo felt table game (1406) according to a set of conventional casino game rules, and determining the outcome of the jackpot (1502) according to a combination of dice thrown in the Sic Bo felt table game (1406), wherein the outcome of the jackpot (1506) is determined according to first three dice thrown in the Sic Bo felt table game and a separate jackpot wager bet is accepted at at least one live table game contributing to one jackpot pool having a payout.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

I claim:

1. A method of operating a gaming system, the method comprising:

enabling at least a first player to place a bet on a play of a Sic Bo game at a gaming table, independent of any placement of any bet by a second, different player on the play of the Sic Bo game, enabling the second player to place a bet, in bet units, on a jackpot, wherein, the second player is at a betting terminal which is configured to:

responsive to a physical item being received via an acceptor, establish a credit balance based, at least in part, on a monetary value associated with the received physical item, display, on a video display area, the play of the Sic Bo game at the gaming table, and responsive to a cashout input being received via a cashout device, cause an initiation of any payout associated with the credit balance, determining a Sic Bo outcome of the play of the Sic Bo game, the determined Sic Bo outcome associated with a Sic Bo payout, and for any bet placed on the jackpot by the second player, determining, by the betting terminal, a jackpot payout according to a combination of dice thrown in the play of the Sic Bo game, wherein different combinations of dice having different probabilities of being thrown in the play of the Sic Bo game are associated with different jackpot payouts.

2. The method of claim 1, wherein the jackpot payout is from 5% to 100% of a total jackpot pool.

3. The method of claim 1, wherein the different combinations of dice thrown associated with different jackpot payouts are selected from the group consisting of: three dice of a kind, two dice of a kind, individual numbers, a specific combination of two dice and a specific combination of three dice.

4. The method of claim 1, wherein a percentage of the jackpot pool is accumulated as a jackpot seed value for a next jackpot pool.

5. A gaming system comprising:

a gaming table on which a live Sic Bo game is configured to be played, wherein a first player is enabled to place a bet on the play of the live Sic Bo game and a Sic Bo outcome is determined for the play of the live Sic Bo game, the determined Sic Bo outcome associated with a Sic Bo payout, and a betting terminal comprising:

a plurality of input devices comprising an acceptor, and a cashout device, a display device, a processor, and a memory device which stores a plurality of instructions, which when executed by the processor, cause the processor to:

responsive to a physical item being received via the acceptor, establish a credit balance based, at least in part, on a monetary value associated with the received physical item, independent of any placement of any bet by a second, different player on the play of the live Sic Bo game, enable the second player to place a bet, in bet units, on a jackpot, cause the display device to display the play of the live Sic Bo game at the gaming table, for any bet placed on the jackpot by the second player, determining a jackpot payout according to a combination of dice thrown in the play of the live Sic Bo game at the gaming table, wherein different combinations of dice having different probabilities of being thrown in the play of the Sic Bo game are associated with different jackpot payouts, and responsive to a cashout input being received via the cashout device, cause an initiation of any payout associated with the credit balance.

6. The gaming system of claim 5, wherein the jackpot payout of the jackpot is from 5% to 100% of a total jackpot pool.

7. The gaming system of claim 5, wherein the different combinations of dice thrown associated with different jackpot payouts are selected from the group consisting of: three dice of a kind, two dice of a kind, individual numbers, a specific combination of two dice and a specific combination of three dice.

8. The gaming system of claim 5, wherein a percentage of the jackpot pool is accumulated as a seed for a next jackpot pool.

9. A betting terminal comprising:

a plurality of input devices comprising an acceptor, and a cashout device, a display device, a processor, and a memory device which stores a plurality of instructions, which when executed by the processor, cause the processor to:

responsive to a physical item being received via the acceptor, establish a credit balance based, at least in part, on a monetary value associated with the received physical item, independent of any placement of any bet by a first player on a play of a live Sic Bo game occurring at a gaming table, enable the first player to place a bet, in bet units, on a jackpot, wherein a second, different player is enabled to place a bet on the play of the live Sic Bo game and a Sic Bo outcome is determined for the play of the live Sic Bo game, the determined Sic Bo outcome associated with a Sic Bo payout, cause the display device to display the play of the live Sic Bo game at the gaming table, for any bet placed on the jackpot by the first player, determine a jackpot payout according to a combination of dice thrown in the play of the live Sic Bo game, wherein different combinations of dice having different probabilities of being thrown in the play of the Sic Bo game are associated with different jackpot payouts, and responsive to a cashout input being received via the cashout device, cause an initiation of any payout associated with the credit balance.

10. The betting terminal of claim 9, wherein the jackpot payout of the jackpot is from 5% to 100% of a total jackpot pool.

11. The betting terminal of claim 9, wherein the different combinations of dice thrown associated with different jackpot payouts are selected from the group consisting of: three dice of a kind, two dice of a kind, individual numbers, a specific combination of two dice and a specific combination of three dice.

12. The betting terminal of claim 9, wherein a percentage of the jackpot pool is accumulated as a seed for a next jackpot pool.

* * * * *